US007237690B2

(12) United States Patent
Stern

(10) Patent No.: US 7,237,690 B2
(45) Date of Patent: Jul. 3, 2007

(54) NOVELTY OBJECT DISPENSER STRUCTURE

(76) Inventor: Marilyn Stern, 2336 California St., NW., Washington, DC (US) 20008

( * ) Notice: Subject to any disclaimer, the term of this patent is extended or adjusted under 35 U.S.C. 154(b) by 341 days.

(21) Appl. No.: 10/704,826

(22) Filed: Nov. 12, 2003

(65) Prior Publication Data

US 2004/0094563 A1 May 20, 2004

Related U.S. Application Data

(60) Provisional application No. 60/425,329, filed on Nov. 12, 2002.

(51) Int. Cl.
*A24F 15/04* (2006.01)

(52) U.S. Cl. ..... 221/24; 221/45; 221/46; 221/63

(58) Field of Classification Search ..... 221/24, 221/45, 63, 33, 46; 206/449, 494, 812
See application file for complete search history.

(56) References Cited

U.S. PATENT DOCUMENTS

| | | | | | |
|---|---|---|---|---|---|
| 479,820 | A | * | 8/1892 | Little | 40/419 |
| 553,872 | A | * | 2/1896 | Roovers et al. | 194/253 |
| 2,506,719 | A | * | 5/1950 | Gregg | 221/24 |
| 3,988,855 | A | | 11/1976 | Crabtree et al. | |
| 4,274,224 | A | | 6/1981 | Pugh et al. | |
| 4,623,318 | A | | 11/1986 | Tsiknopoulos et al. | |
| 4,669,998 | A | | 6/1987 | Amici et al. | |
| 4,998,644 | A | * | 3/1991 | Pan | 221/24 |
| 5,516,314 | A | | 5/1996 | Anderson | |
| 5,562,328 | A | * | 10/1996 | Schottenfeld | 312/35 |
| 5,850,940 | A | * | 12/1998 | Sloan et al. | 222/78 |
| 5,989,095 | A | | 11/1999 | Wotton | |
| D418,556 | S | | 1/2000 | Lee et al. | |
| 6,053,357 | A | | 4/2000 | Yoh | |
| 6,056,235 | A | | 5/2000 | Brozinsky | |
| 6,089,950 | A | | 7/2000 | Lee et al. | |
| 6,098,836 | A | | 8/2000 | Gottselig | |
| 6,110,002 | A | | 8/2000 | Langton | |
| 6,120,344 | A | | 9/2000 | Brown | |
| 6,170,725 | B1 | | 1/2001 | Ganues | |
| 6,196,435 | B1 | | 3/2001 | Wu | |
| 6,237,759 | B1 | | 5/2001 | Wotton | |
| 6,287,166 | B1 | | 9/2001 | Lee et al. | |
| 6,328,625 | B1 | | 12/2001 | Lee et al. | |
| 6,349,849 | B1 | | 2/2002 | Pehr | |
| 6,364,185 | B2 | | 4/2002 | Wu | |
| 6,409,516 | B1 | | 6/2002 | Thill | |
| 6,419,114 | B1 | | 7/2002 | Lenz et al. | |
| 6,422,916 | B1 | | 7/2002 | Enku | |
| 6,435,938 | B1 | | 8/2002 | Lee et al. | |
| 2003/0070955 | A1 | * | 4/2003 | Kuske et al. | 206/494 |

OTHER PUBLICATIONS

Funkyzilla.com [online] , [retrieved on Sep. 2, 2002] Retrieved from the internet <URL:http://www.funkyzilla.com/home/catcover15.html>.

Forbes Marketing Group [online], [retrieved on Nov. 4, 2002] Retrieved from the internet <URL:http://www.forbesmarketing.com/deskaccessories.htm>.

* cited by examiner

*Primary Examiner*—David H. Bollinger
(74) *Attorney, Agent, or Firm*—Dickstein Shapiro LLP

(57) ABSTRACT

A product dispenser attached to or associated with one or more articulating members or components, which are user manipulable to provide a novelty object dispenser.

69 Claims, 19 Drawing Sheets

NOVELTY OBJECT DISPENSER STRUCTURE

This application claims priority to U.S. provisional application No. 60/425,329, filed on Nov. 12, 2002, which is herein incorporated by reference in its entirety.

FIELD OF THE INVENTION

The present invention relates to a decorative novelty object dispenser structure for use in dispensing objects in the home or other environments.

BACKGROUND OF THE INVENTION

Product dispensers, such as a tissue box, are typically produced with mundane features that are generally ignored by potential users. Accordingly, such product dispensers fail to draw attention to the dispenser and are generally ignored until a dispensed object such as a tissue is needed. No additional functionality, beyond the dispensing function is provided.

BRIEF SUMMARY OF THE INVENTION

The invention provides an object dispenser having an associated user manipulable attachment that provides an improved and attractive novelty item. In an exemplary embodiment, the invention provides an object dispenser, such as a tissue container, with an articulating anatomical member that is manipulable by a user to assume different poses thereby providing an additional entertaining functionality to the dispenser.

BRIEF DESCRIPTION OF THE DRAWINGS

The above and other features and advantages of the invention will be more readily understood from the following detailed description which is provided in connection with the accompanying drawings, in which.

DETAILED DESCRIPTION OF THE INVENTION

An object dispenser having an associated user manipulable attachment is presented and provides an improved and attractive novelty item. In an exemplary embodiment, the invention includes a tissue-dispensing container with an articulating anatomical figure. However, many types of object containers, articulating or manipulable attachments, coupling arrangements between an attachment and a container, as well as other features, such as lighting effects, are possible as well.

Figure 1A:
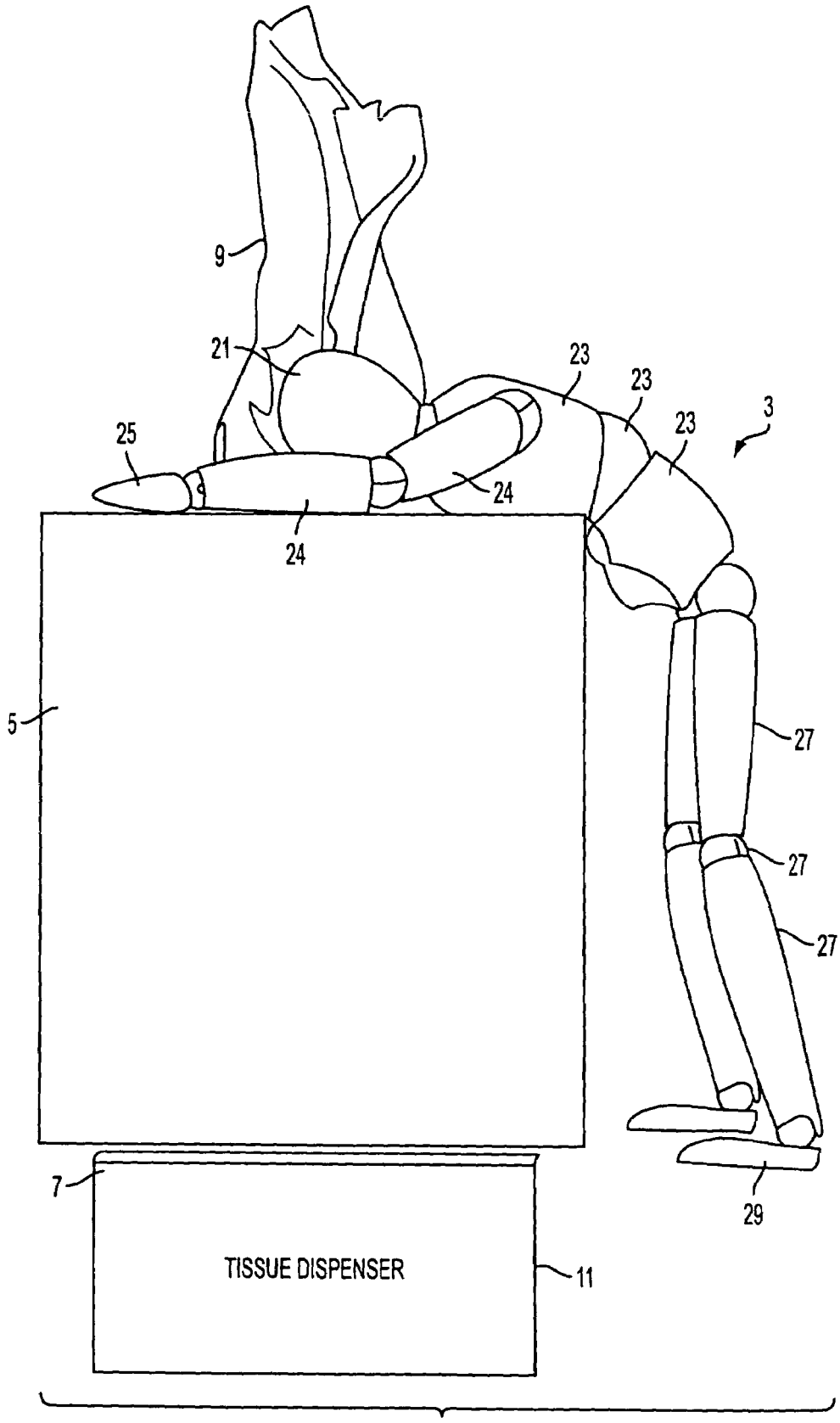
FIG. 1A shows a side view of a novelty tissue box container with a manipulable attachment in accordance with a first exemplary embodiment of the invention.

A first exemplary embodiment of the invention is shown in FIGS. 1A, 1B, 1C and 1D as a container for dispensing facial tissues. Referring to FIG. 1A, an anatomical human shaped member 3 is attached to a container 5 for dispensing tissues 9. The container 5 is configured to fit over a tissue dispenser 7 that dispenses the tissues 9. Tissue dispenser 7 is inserted into an opening 11 in the bottom of container 5. The container 5 is constructed to permit the dispensing of a tissue 9 from dispenser 7 through an opening 31 (FIG. 1B) in the top portion of the container 5. However, in another embodiment of the invention, the tissue dispenser 7 can be eliminated and tissues 9 may be arranged within the container 5 and dispensed directly through the opening 31.

The member 3 is attached to the container 5 in a manner that affords an opportunity for a user to manipulate the member 3 relative to the container 5. The illustrated member 3 includes articulating components including a head 21 attached to a torso 23, a set of arms 24 attached to the torso 23, a hand representation 25 attached to each arm 24, jointed legs 27 attached to the torso 23, and a foot representation 29 attached to each leg 27. The head 21, torso 23, legs 27, hand representation 25 and feet representations 29 are all articulated and freely movable by a user of the container 5.

Figure 1B:
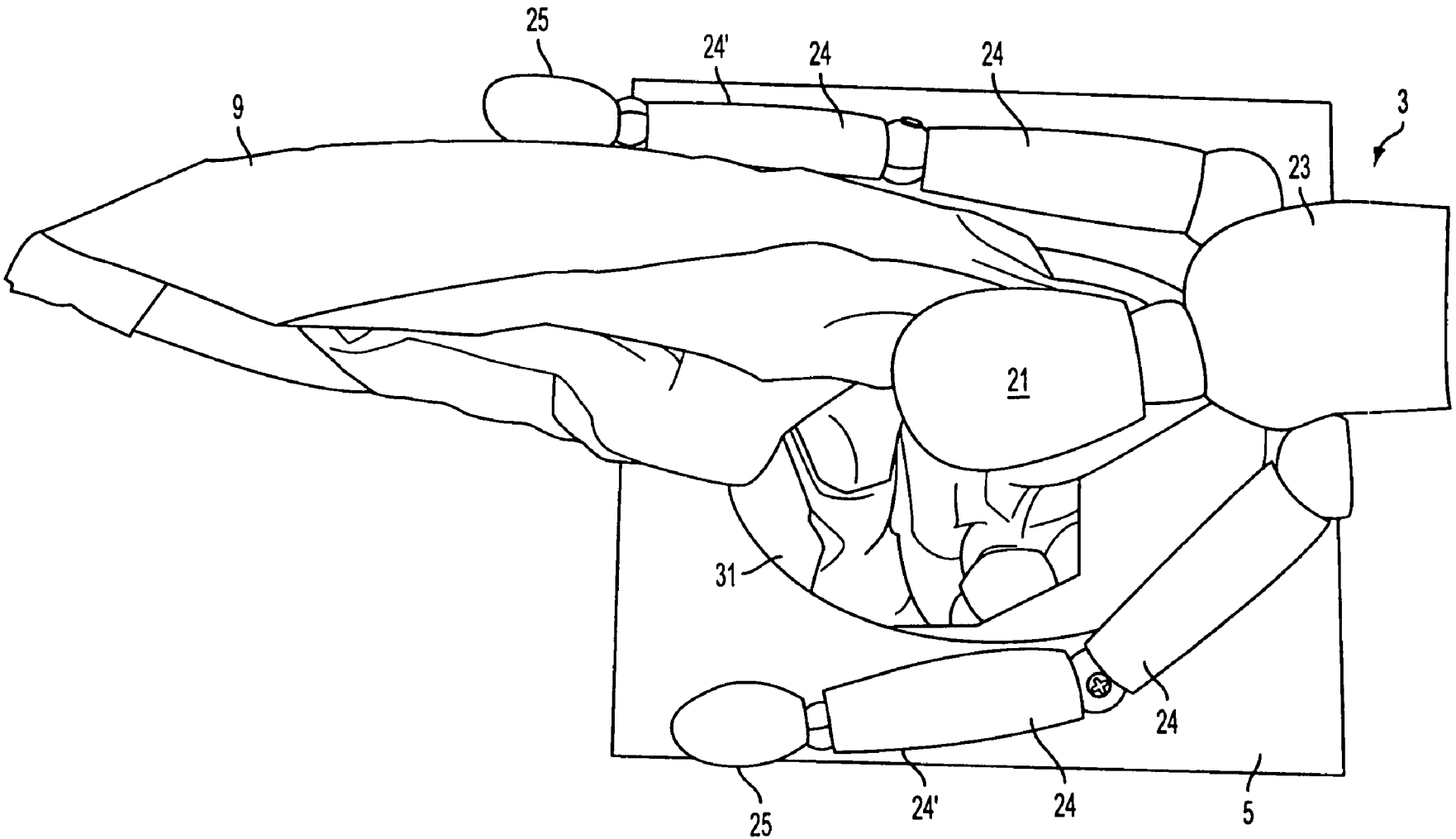
FIG. 1B shows a top view of the FIG. 1A exemplary embodiment.
Figure 1C:
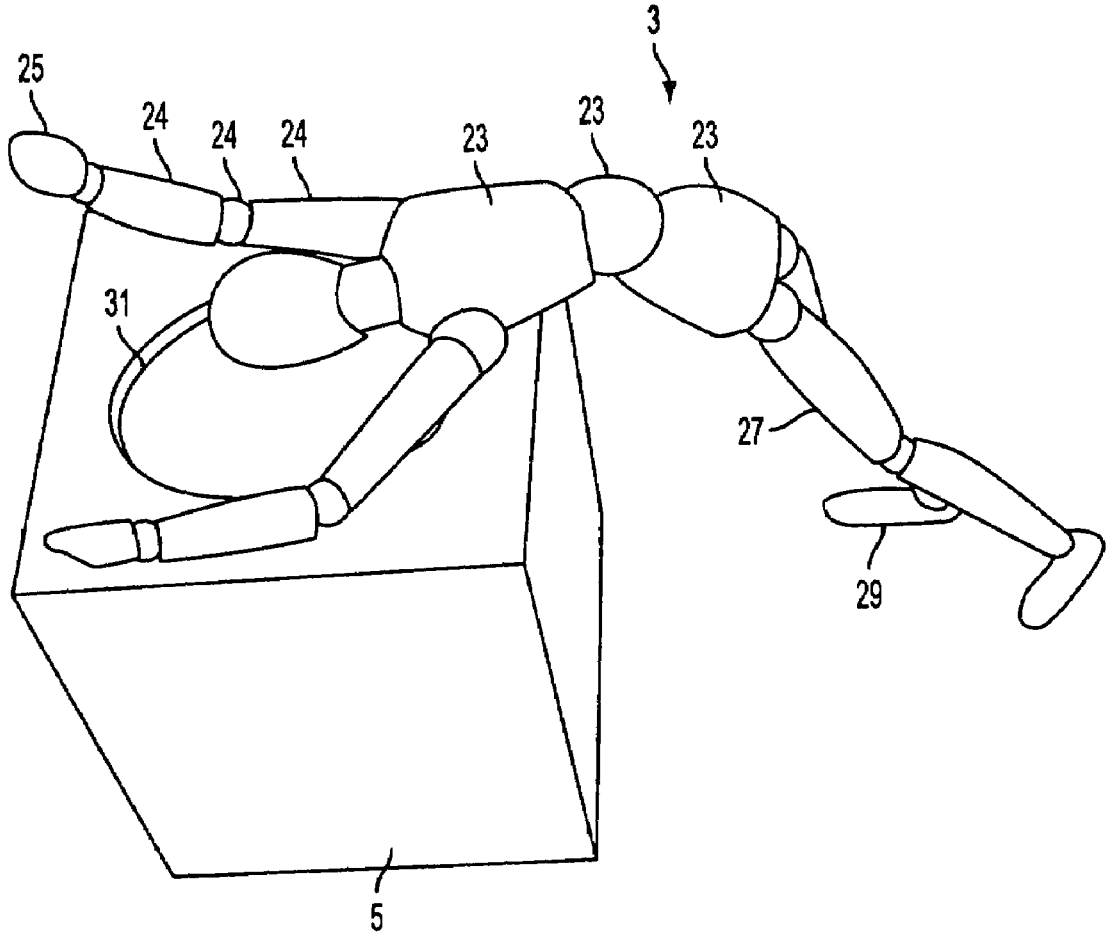
FIG. 1C shows a perspective view of the FIG. 1A embodiment.

The member 3 can be attached to container 5 at various locations on the container 5. Referring to FIG. 1B, one such attachment location is shown in which an outermost portion 24' of the arms 24 are attached to the top of container 5 such that one arm 24 is attached to the top of container 5 on either side of opening 31. The articulating member 3 is attached to the container 5 such that the member 3 can be variously posed to express different emotions, thoughts or expressions as selected by the user. For example, FIG. 1A shows member 3 in a reflective pose where the head 21 appears to be looking into the opening 31 with the legs 27 and feet 29 positioned on a surface upon which the container 5 is resting. Tissues 9 are pulled through the opening 31 and around the head 21, arms 24 and torso 23. The member 3 can assure many different poses with respect to container 5 while still permitting dispensed objects to easily be removed from container 5. FIG. 1C shows a perspective view of the FIG. 1A arrangement, which also displays the arrangement of the member 3 with respect to the opening 31.

Figure 1D:
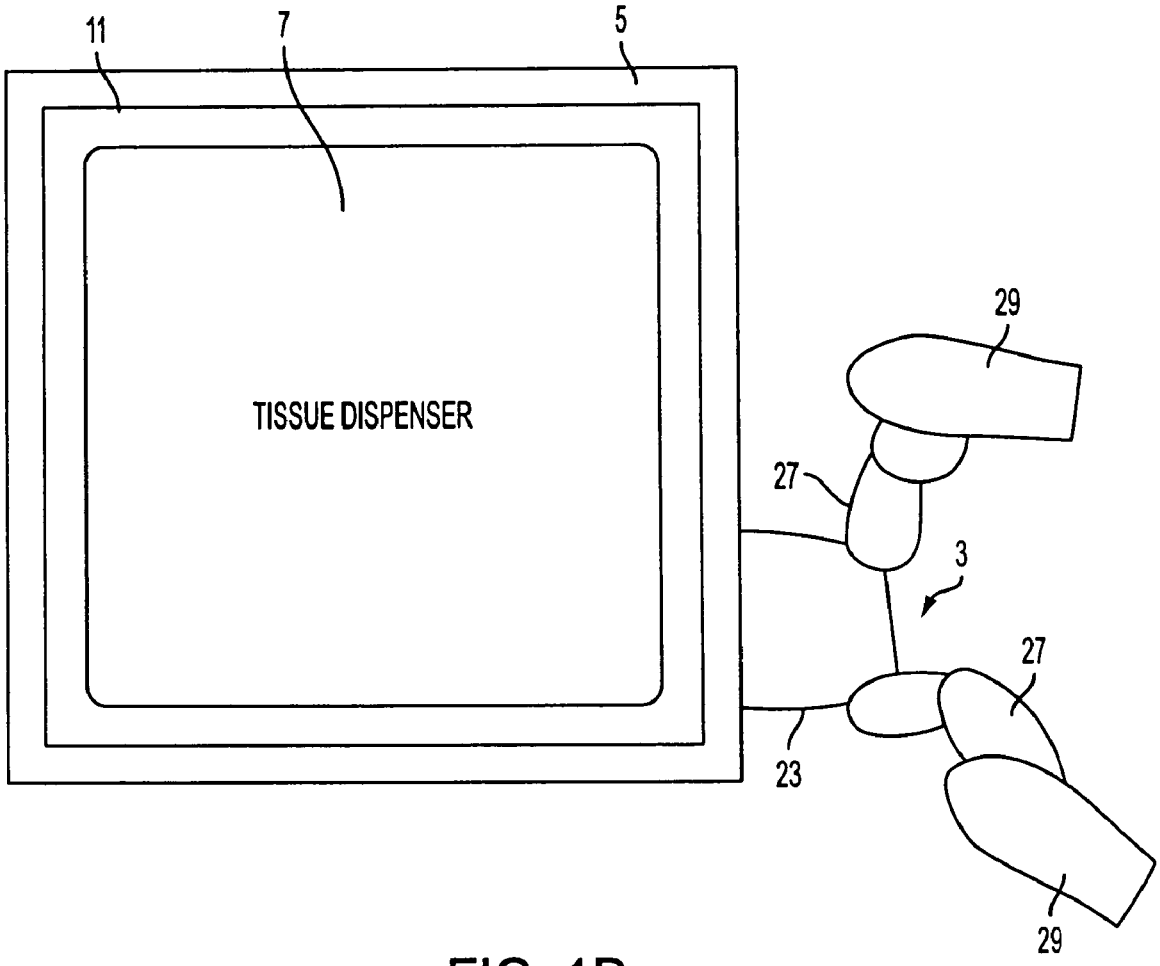
FIG. 1D shows a bottom view of the FIG. 1A embodiment.

Referring to FIG. 1D, a bottom view of the FIG. 1A container 5 and articulating member 3 are shown. Objects or products present within container 5 can be loaded into the container 5 through an opening 11 in the bottom of the container 5. It should be noted that any variety of loading mechanisms or arrangements for dispensed objects are capable of being used with container 5.

The articulating member, e.g. member 3, attached to container 5 can also be outfitted with clothing, hats or other accessories as well as adorned with a variety of distinctive markings, which encourages different poses of and/or locations for member 3. Although member 3 is shown as having a human form, any type of figure having manipulable components such as arms, legs, torsos, heads, tails, etc. can be employed.

The attachment of the member 3 to container 5 may be permanent or temporary. For permanent connection, any well known fasteners or adhesives can be used. For a temporary connection, the attachment of member 3 to container 5 can be made with a suction cup, Velcro®, semi-adhesive substance or other temporary adhering structure/material.

Figure 2:
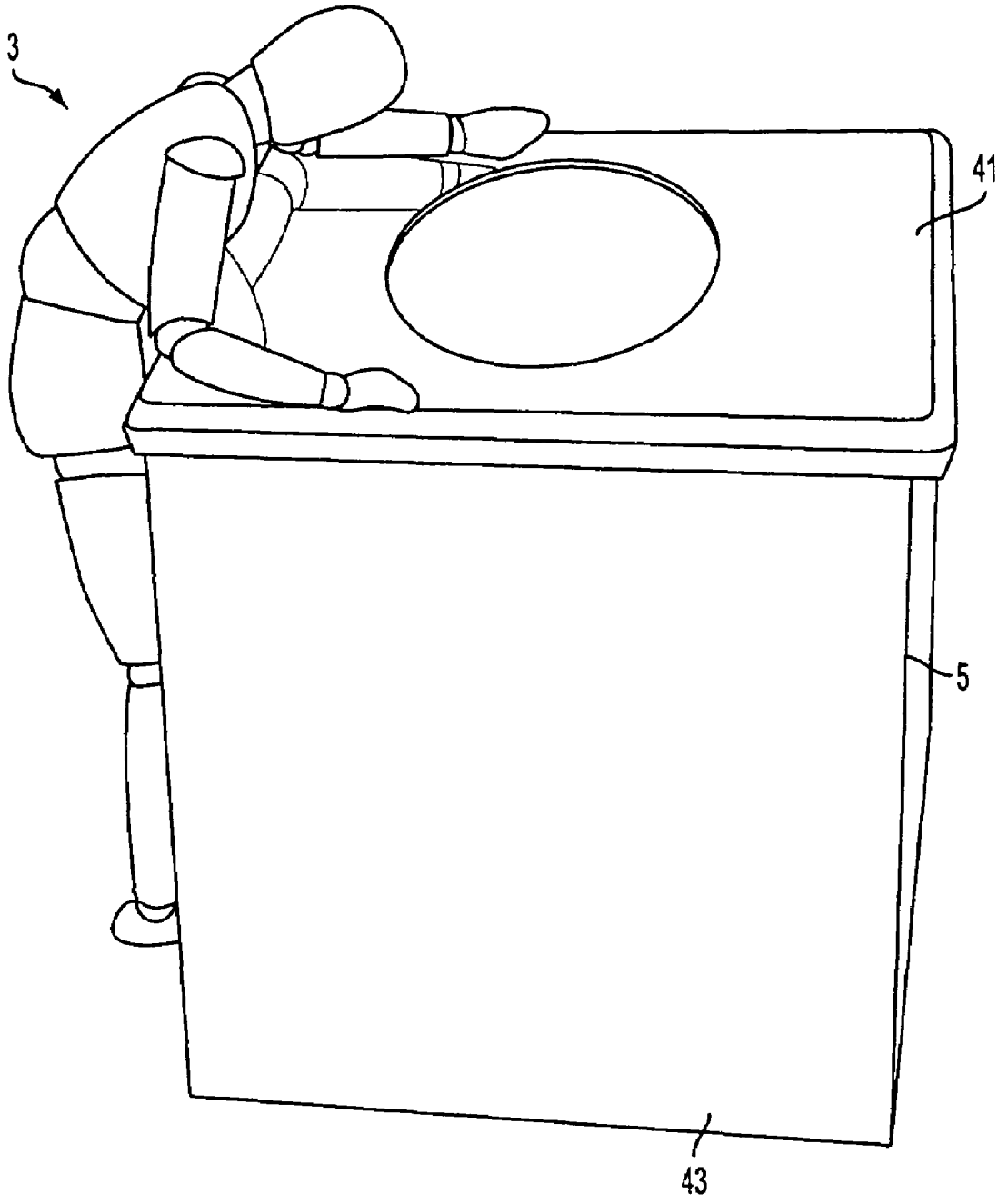
FIG. 2 shows a perspective view of another exemplary embodiment of the invention.

Referring to FIG. 2, container 5 may have exterior ornamentation such as a reflective top 41 and side 43. Different shaped containers may also be adapted for use with a variety of dispensed objects in addition to a variety of articulating figures or other articulating assemblies.

Figure 3:
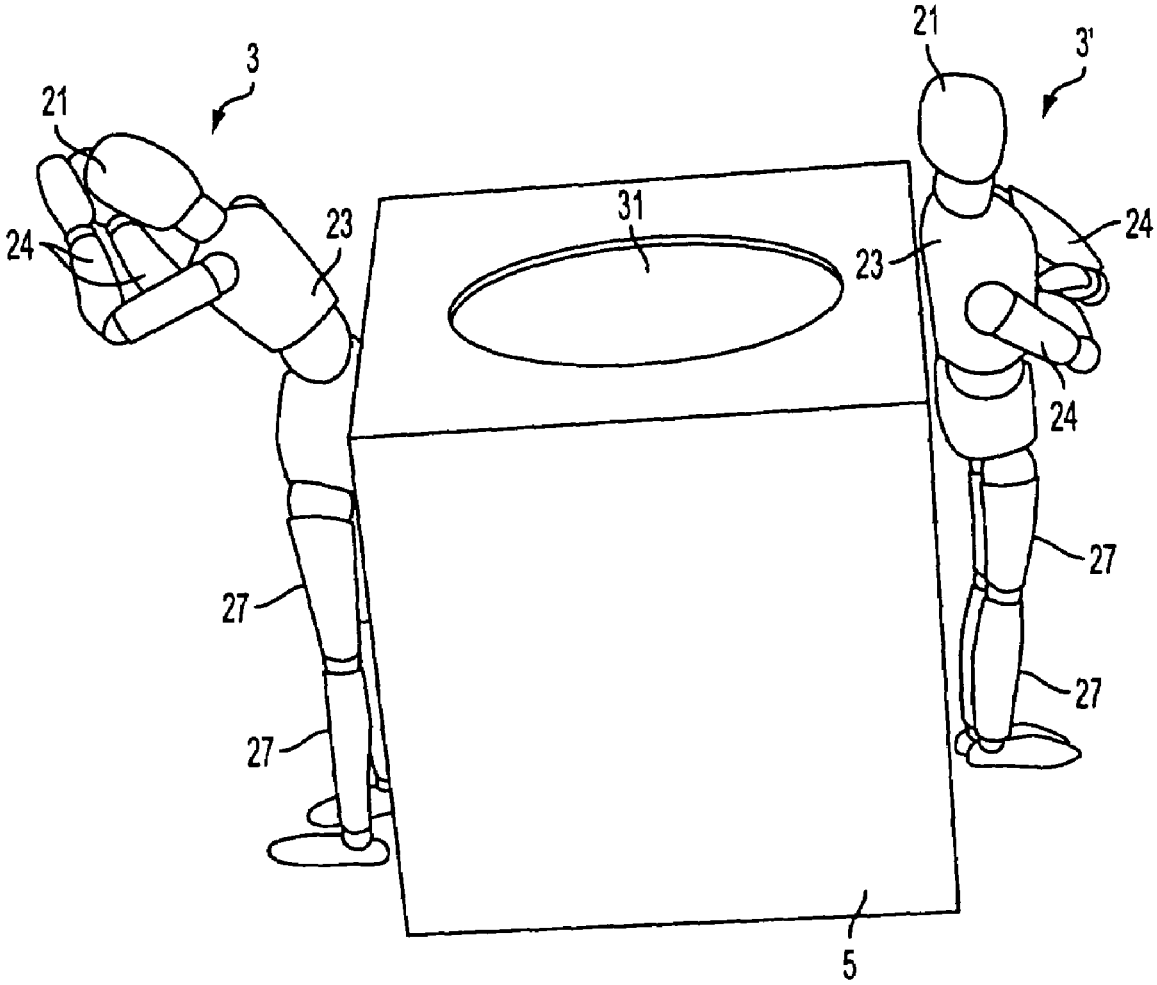
FIG. 3 shows a perspective view of another exemplary embodiment of the invention.

FIG. 3 shows another exemplary embodiment that employs two articulating human like members 3, 3', which can be attached to the container 5. In this embodiment, one member 3 is attached to one side of container 5 facing away from the container 5. The other member 3' is attached to another side of the container 5 such that a rear section of the member 3' torso or body section is attached to the container and the front portion of member 3' is facing away from container 5. The legs 27, arms 24, a portion of torso 23 and heads 21 of members 3 and 3' remain freely moveable into a variety of postures as desired by a user. The tissues 9 remain free to be dispensed or accessed by a user through opening 31 in the top portion of container 5.

Figure 4:
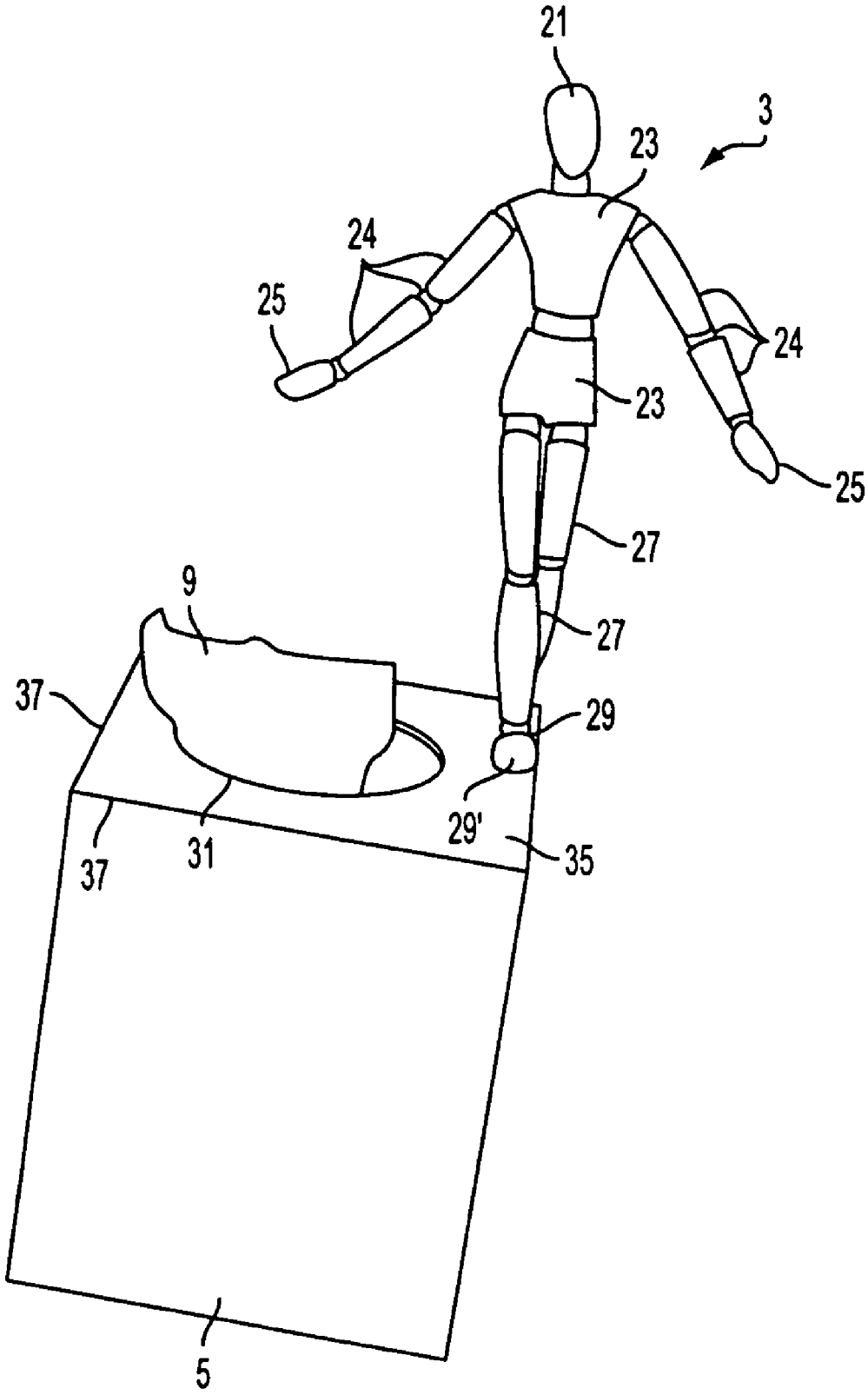
FIG. 4 shows a perspective view of another exemplary embodiment of the invention.

FIG. 4 shows another exemplary embodiment with a different configuration of the articulating member. An articulating human anatomical member 3 is shown attached by its foot sections 29, 29' to container 5 along an outside edge of the top section 35 of container 5. In this embodiment, member 3 is shown with one foot 29' in front of another foot 29 suggesting that the member 3 is walking along the edge portion of the top surface 35 of container 5.

Figure 5:
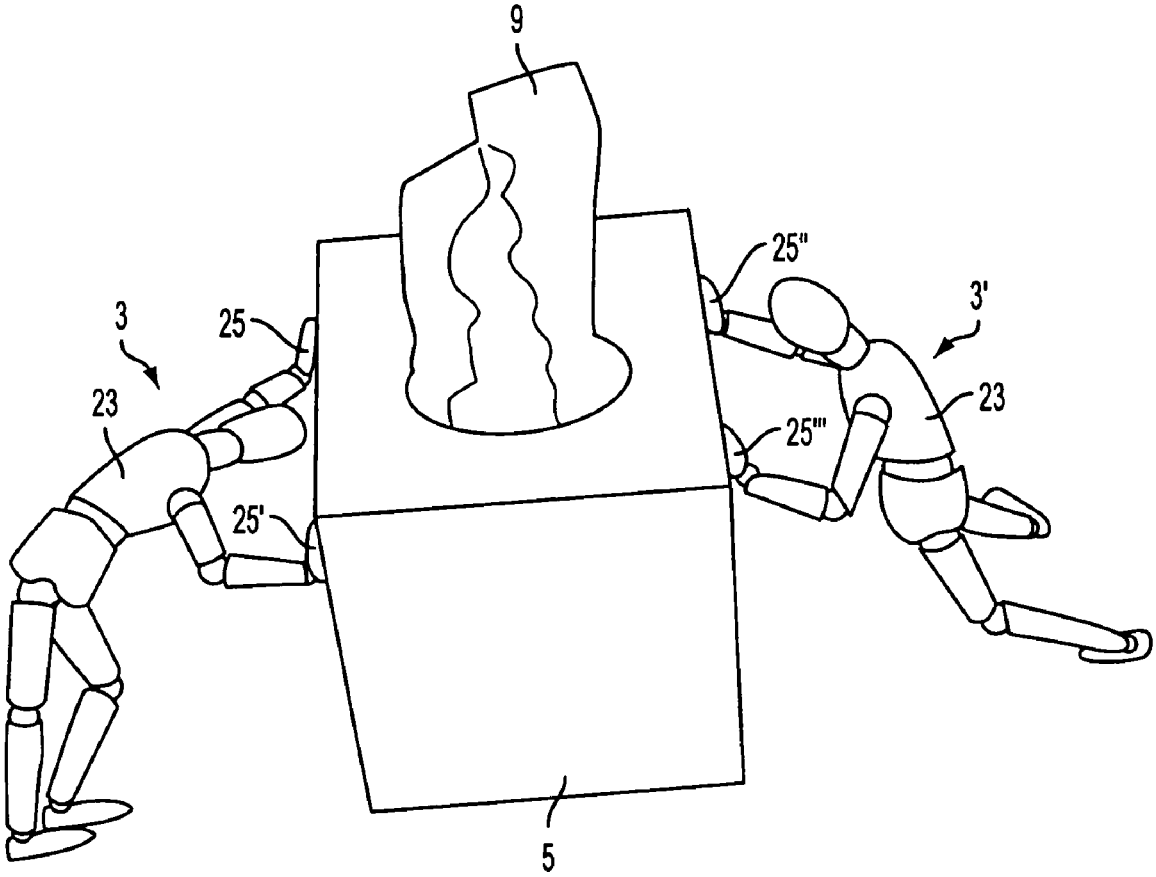
FIG. 5 shows a perspective view of another exemplary embodiment of the invention.

FIG. 5 shows another exemplary embodiment of the invention. In this embodiment, hand sections 25, 25' of an articulating human anatomical member 3 are attached to one side of container 5. Another articulating human anatomical member 3' is attached to container 5 by its hand portions 25", 25'" on an opposing side of container 5 from member 3. The rest of the articulating components of both members 3, 3' remain free to articulate. In this representation, members 3, 3' are posed such that they appear to be two human figures that are pushing the container 5 towards each other from opposite sides. However, members 3, 3' can be manipulated in any manner that the articulation joints of the members 3, 3' permit.

Figure 6:
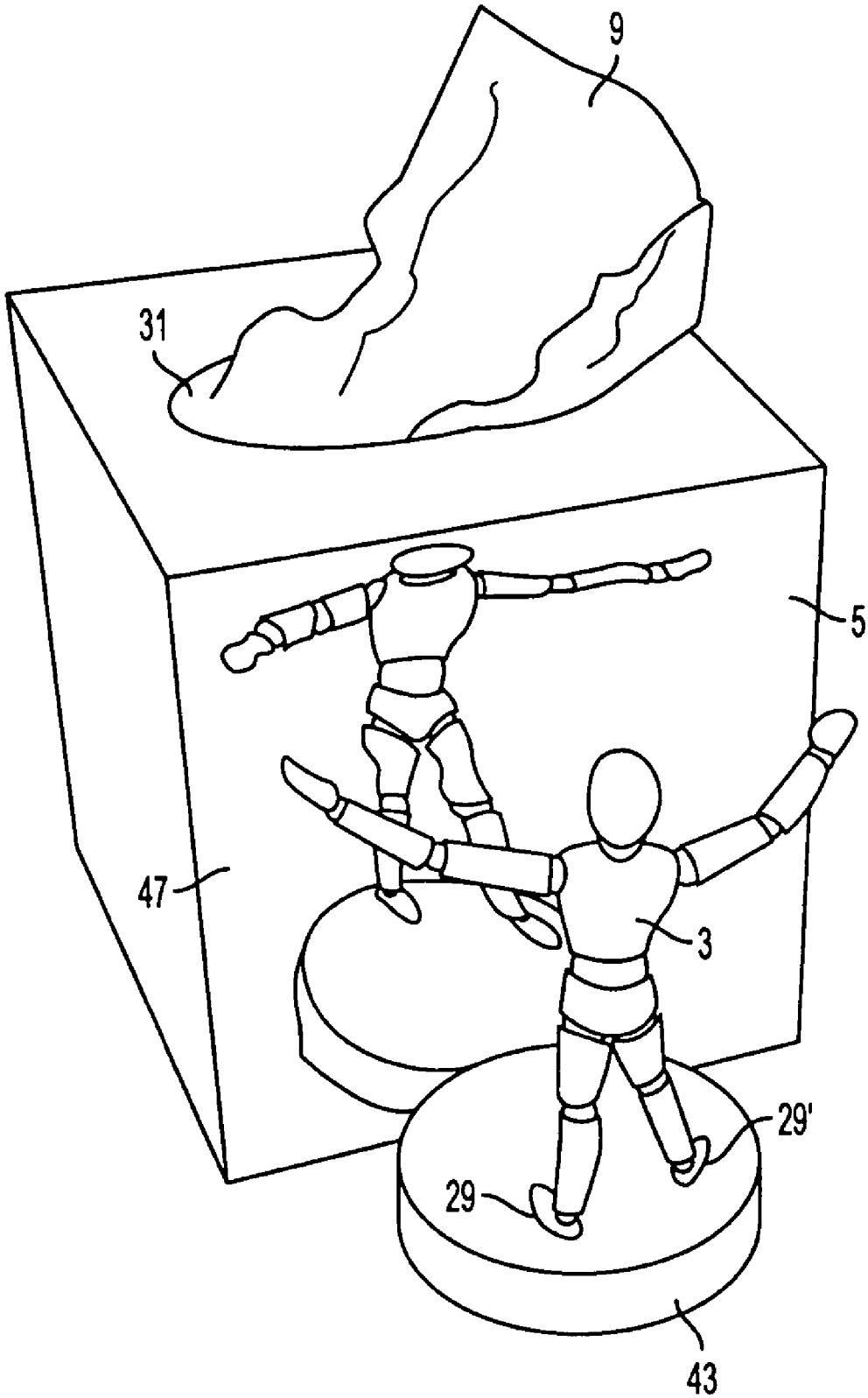
FIG. 6 shows a perspective view of another exemplary embodiment of the invention.

FIG. 6 shows another exemplary embodiment of the container 5 and articulating figure. Here, an articulating human anatomical member 3 is attached to a base 43 of container 5 by its feet 29, 29'. The base 43 is attached to a lower section of a side 47 of container 5 in such a manner that the bottom portion of the base 43 is flush with the bottom portion of container 5 and member 3 faces towards the side 47 of container 5. In other words, member 3 is attached to base 43 that is attached to container 5. Other embodiments can vary the attachment point for the base 43 to the container 5 as well as member 3 to base 43. The side 47 facing the member 3 in this exemplary embodiment may be reflective so that a user can articulate member 3 and pose member 3 such that the member 3 seems to be examining his/her reflection in reflective side 47. A variety of reflective surfaces can be employed including surfaces that reflect a true image of member 3 as well as a distorted image of member 3 that, for example, enlarges or diminishes different portions of member 3.

Figure 7:
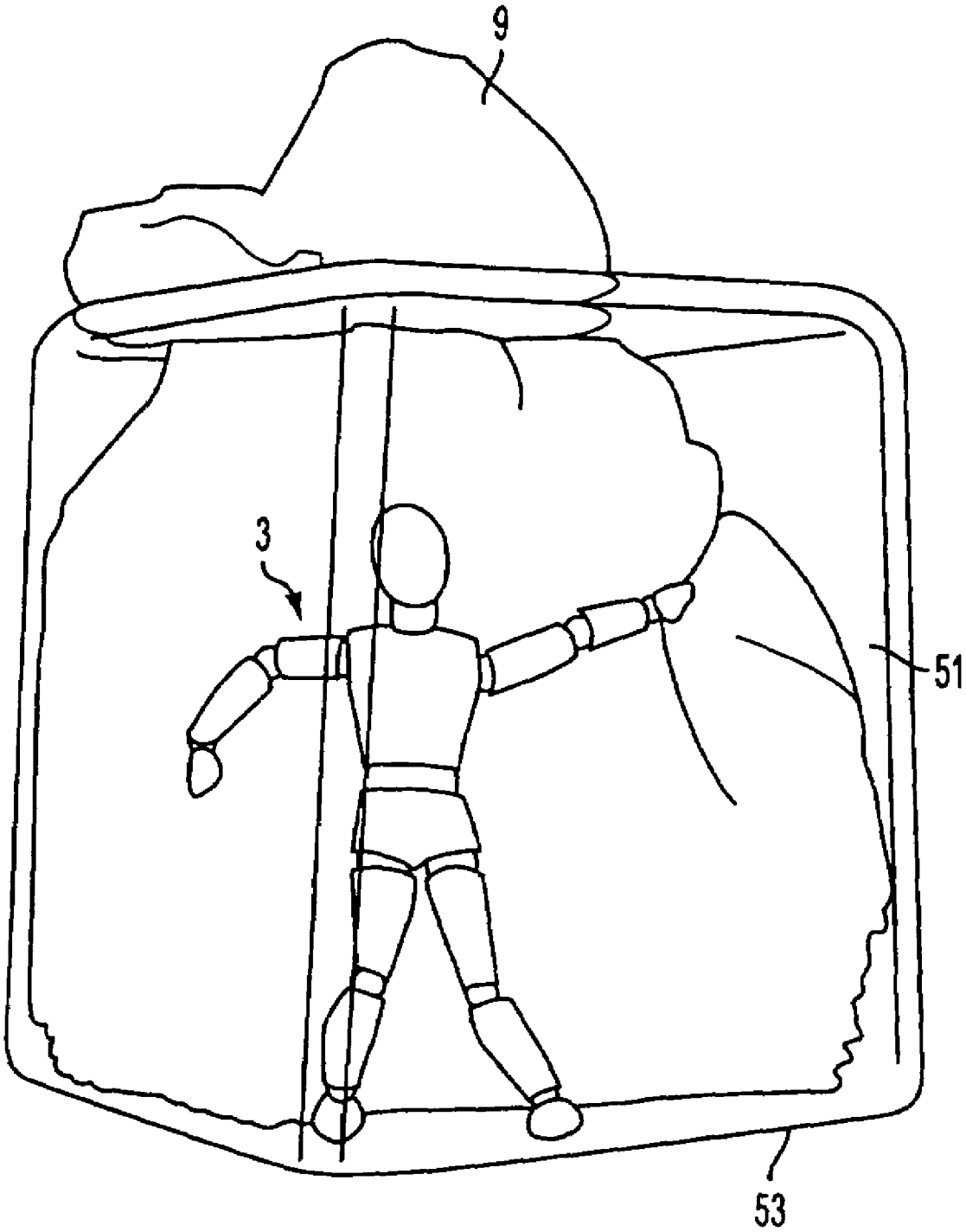
FIG. 7 shows a perspective view of another exemplary embodiment of the invention.

FIG. 7 shows another exemplary embodiment of the invention. In this embodiment, container 51 of the prior embodiments is replaced by a transparent container 51 that houses tissues 9 and has an attached articulating human anatomical member 3 within container 51. The member 3 can be accessed through an opening in the bottom of container 51 by lifting the transparent container 51 off a surface that container 51 is resting upon. The member 3 can be articulated with respect to the contained objects, e.g., tissues 9, and then the transparent container 51 can be placed over both member 3 and objects, e.g., tissue 9. An opening in the top portion of container 51 provides access for retrieval or use of tissues or other dispensed objects. It should be noted that the member 3 can be attached to container 51 or it can be separate therefrom. In either case, member 3 is positioned within container 51 and is viewable from the exterior of container 5.

Figure 8:
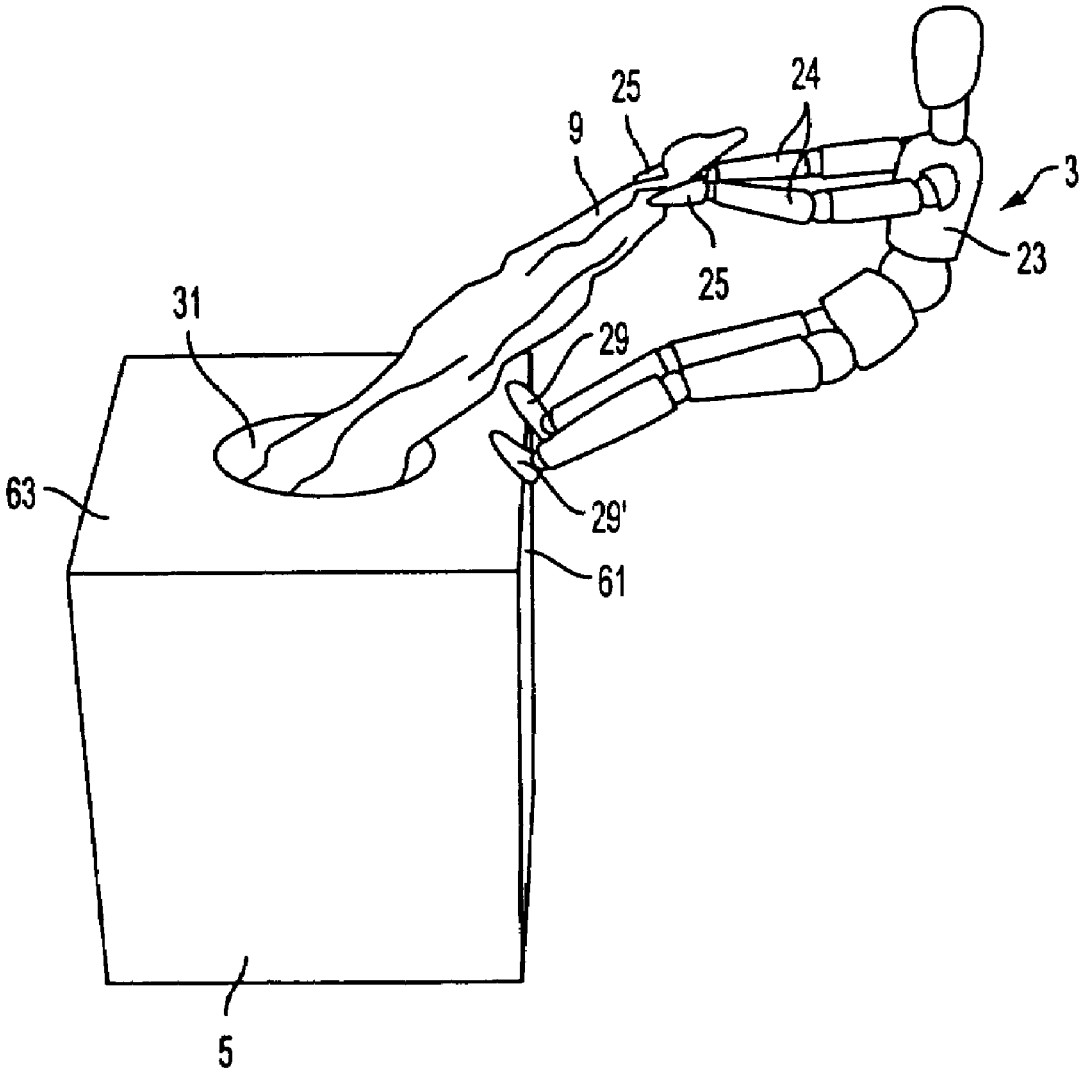
FIG. 8 shows a perspective view of another exemplary embodiment of the invention.

FIG. 8 shows another exemplary embodiment employing container 5 and articulating member 3 with respect to an object dispensed from within container 5. In this embodiment, the member 3 is attached to an edge 61 of a top portion 63 of container 5 by foot segments 29, 29' of the member 3 so that the figure is positioned approximately at a 45°–60° angle with respect to the top surface 63 of container 5. In this exemplary embodiment, the arms 24 and hands 25 can be positioned to appear to be tugging on a tissue 9 which is accessible from opening 31 in the top portion 63 of container 5.

Figure 9A:
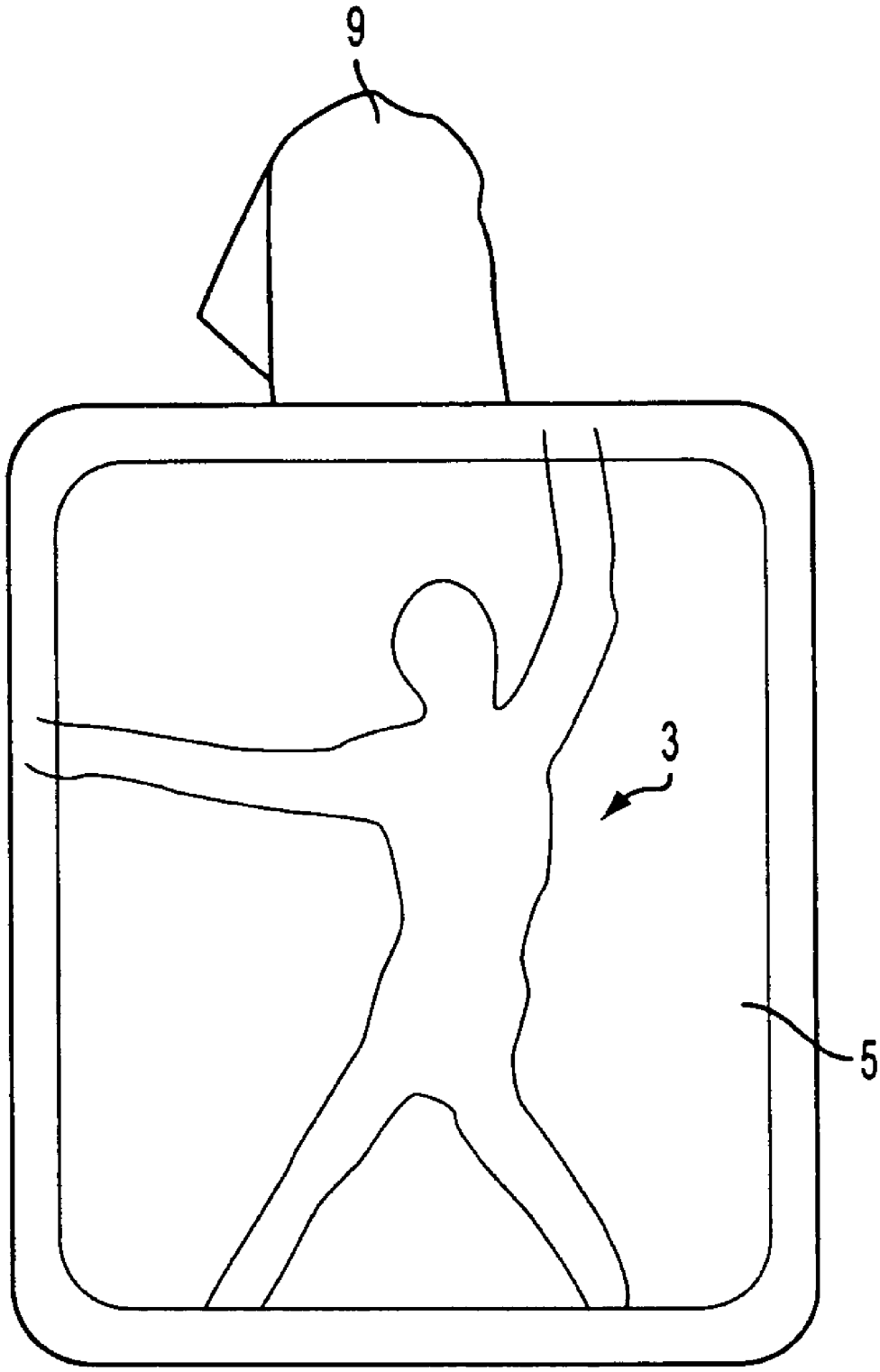
FIG. 9A shows a perspective view of another exemplary embodiment of the invention.

FIG. 9A shows another exemplary embodiment of a container 5 and articulating member with respect to a dispensed product. In this example, container 5 is constructed from a semitransparent material that permits indistinct, or silhouetted, viewing of an articulating human anatomical member 3. Member 3 can be positioned in between objects contained within container 5 and the inner wall of container 5. In this embodiment, container 5 is placed over tissues 9 and member 3 after a user manipulates member 3 to a desired configuration. Member 3 can also be attached to the inside wall of container 5 in a manner which permits member 3 to be manipulated in a manner desired by a user but still retaining member 3 against the inner wall of container 5 to improve ease of loading and unloading of tissues 9 within container 5. The FIG. 9A embodiment can employ a figure that is attached within the area between objects within container 5 and the inner wall or container 5. Alternatively, the FIG. 9A embodiment can employ a figure that is not attached, but instead placed within the area between objects within container 5 and the inner wall of container 5.

Figure 9B:
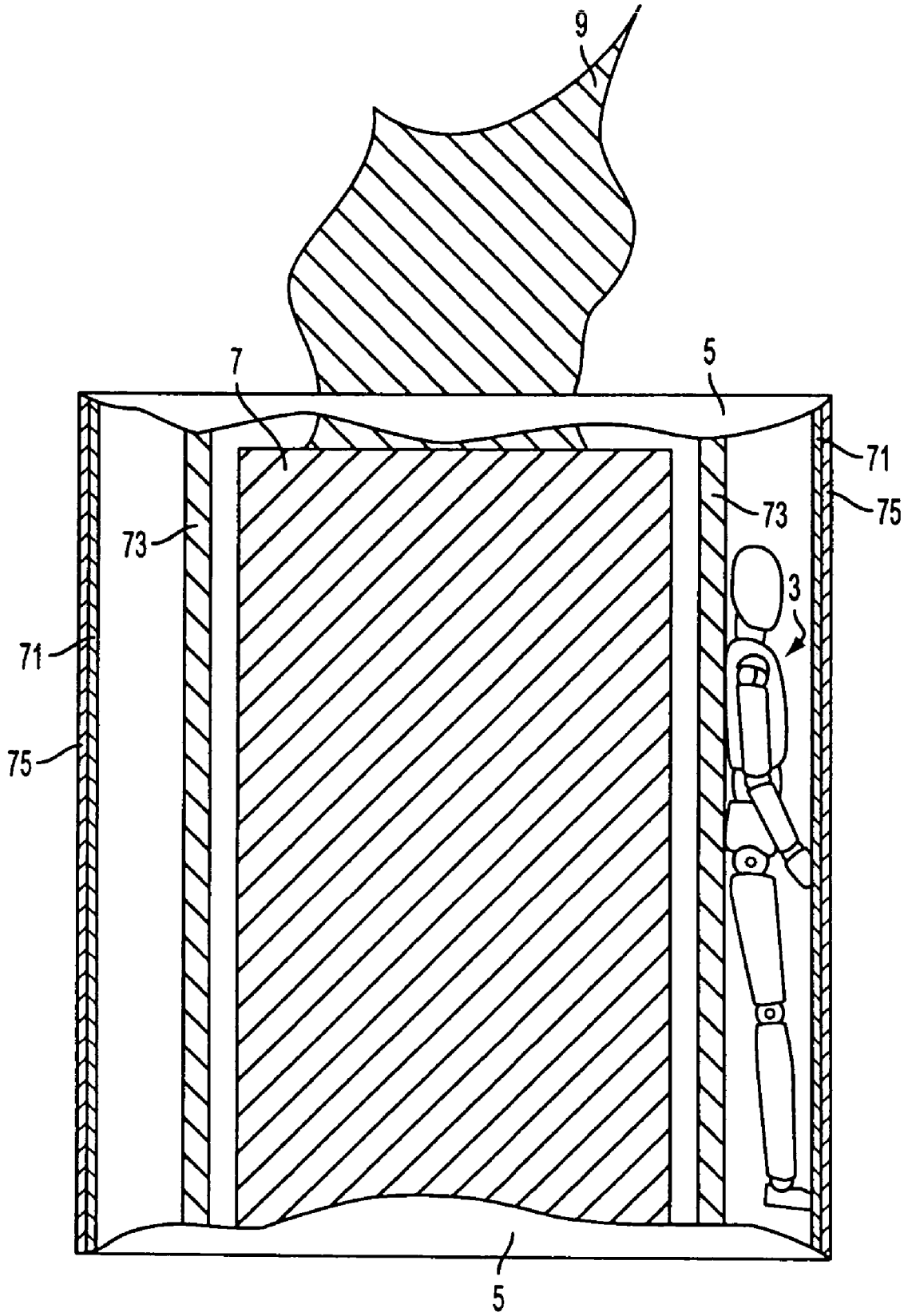
FIG. 9B shows a cut-away side view of the FIG. 9A exemplary embodiment.

FIG. 9B shows a cut away side view of the FIG. 9A embodiment. The container 5 houses an illuminating panel 73 interposed between tissue box 7 and member 3. The illuminating panel 73 can be any suitable lighting fixture that emits a general or irregular light that is directed towards member 3. A semitransparent layer 71 is interposed between member 3 and a wall panel 75 of container 5 that permits an indistinct view of member 3 when member 3 is viewed through the wall panel 75. Alternatively, the walls of the container 5 can be made semitransparent. Member 3 blocks light from illuminating panel 73 such that a shadow of member 3 is formed on layer 71 and wall panel 75. Illuminating panels or devices are well known; accordingly a wide variety of lighting devices may be used in place of panel 73. For example, a light emitting diode (LED) with a lens for distributing emitted light may be installed at the center of panel 75, which is formed into a reflective concave surface and directs or reflects light towards member 3, layer 71 and wall panel 75. A light may be placed at the top and bottom of the cavity where member 3 is located to direct light towards a reflective surface where panel 73 is located.

In the FIGS. 9A, 9B embodiment, member 3 may be manipulated by removal through the bottom of container 5 or can be inserted into a cartridge that is removable from the body of container 5. Strings or rods may also be incorporated into container 5 which may permit the external manipulation of member 3 while remaining within the cavity between panel 73 and layer or panel 75.

Figure 10:
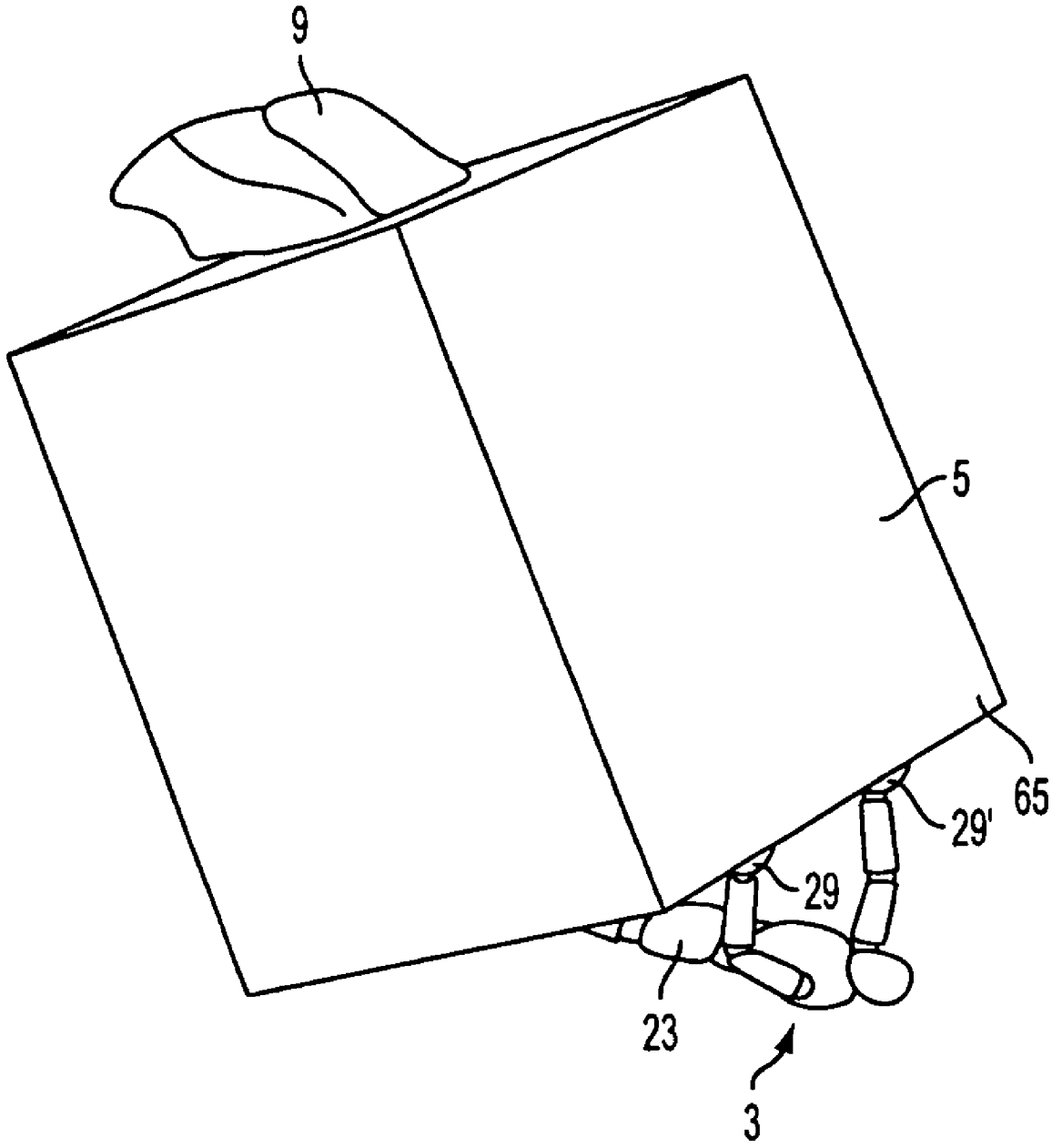
FIG. 10 shows a perspective view of another exemplary embodiment of the invention.

FIG. 10 shows another exemplary embodiment of the invention. In this embodiment, an articulating anatomical human member 3 is placed underneath container 5 such that one bottom edge 65 of container 5 is propped up or elevated with respect to the opposite bottom edge of container 5. Member 3 is oriented such that the torso portion 23 and legs (not shown) are underneath container 5. Hand portions 29, 29' of member 3 are attached to the bottom edge 65. The remainder of member 3 is free to articulate in such a manner as a user of the container combination may desire. As shown, in FIG. 10, the member 3 has been manipulated to make it appear that the figure is holding up an edge of the container 5.

Figure 11:
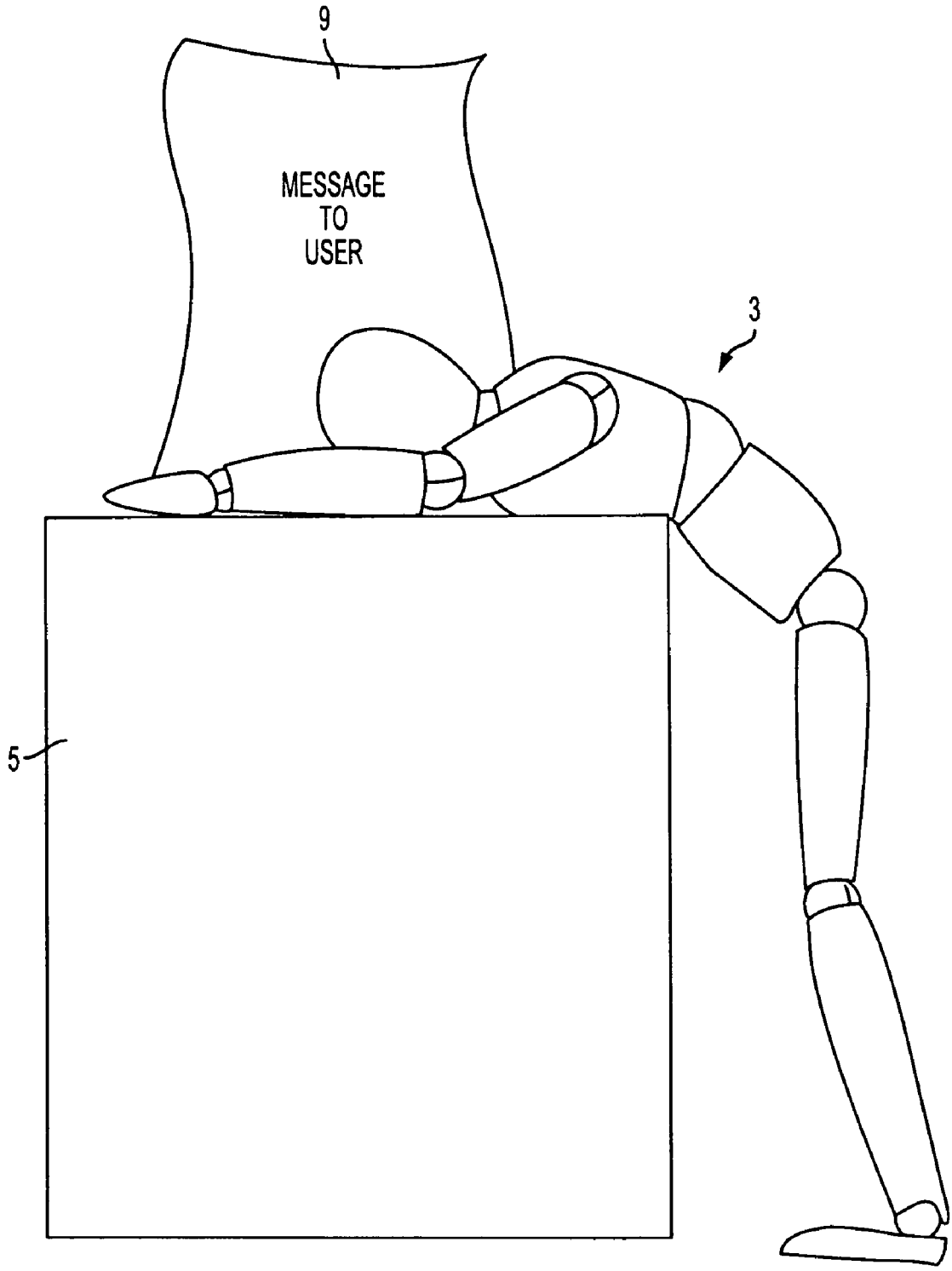
FIG. 11 shows a side view of another exemplary embodiment of the invention.

FIG. 11 shows a variation of the FIGS. 1A–1D embodiment of the invention. This embodiment includes a tissue or product that contains one or more messages printed on tissues 9 (or other product) and are dispensed from container 5. A variety of messages can be included on the product dispensed from container 5. Examples of messages that may be printed on an object dispensed from container 5 include inspirational messages, suggested lottery numbers, jokes, religious verses, fortunes (e.g., fortune cookies), relationship advice, restaurant selections, horoscopes, dinner recipe ideas, humorous messages, quotes as well as cartoons or other depictions that add to an attractive property and attracts a user to use the dispensed product. Accordingly, the present invention may use any type of object or product that may have a message incorporated therein.

Other embodiments can include a coating or material applied to the exterior walls of the container 5 which permits attachment, removal and reattachment of one or more articulating members, such as member 3, at different locations on container 5. One example of such a coating or material is Velcro®. Any other material which permits attachment, removal and reattachment to the same or different portion of container 5 can be used. Magnetic attachment components can be attached to member 3 and used with container that permit an articulating member to be attached and/or moved on or around the container's inside or outside surfaces. For example, referring to FIG. 1A, a magnet can be attached to hand 25 facing towards container 5 which can be constructed of a metal material that couples with the magnet. A user can push hand 25 around such that hand 25 remains coupled to container 5 and held in a new position. A magnet can also be incorporated into the interior of member 3 as well as the appendages or members of member 3. External magnets manipulated by a user can also be used to move an articulating figure or member that is placed within the container. For example, a member 3 can be constructed using materials that are affected or moved by magnetic fields. A magnet can be moved by a user around the outside of a container thereby moving or affecting the positions of the figure.

A variety of articulating members can be selected for use with container 5. For example, the articulating human anatomical figure used in preceding examples can be replaced with an animal, fish, reptile, bird, or other anatomical figure as well as an articulating abstract combination such as a set of longitudinal elements having multiple joints or flexible members, or a facsimile of a robot representation, which represents a futuristic assemblage that may attract a certain type of user personality. Bendable wire or other moveable structures may also be used as an articulating member or construct. The articulation member may be a doll or other figure that is more desirable to a child as compared to an adult. Another articulating member selection criteria can be the environment that the container and articulating member combination will be used within such as a home environment, medical establishment or business office. For example, the dispenser and articulating member combination can be used in a medical diagnostic or therapeutic context where the combination is used as a diagnostic tool. The combination can be used in a manner similar to tests such as ink blot tests or other screening techniques that measure a user's reaction or emotional state. For example, if a user manipulates the articulating member in a way that indicates emotional stress or distress, it can be inferred that the user is experiencing such feelings. Moreover, the product dispensed, such as tissues or even medication, can be selected in accordance with the expected mood a user will be in. If a user is expected to be in a grieving state, then tissues or inspirational message products may be dispensed including a prayer or other uplifting messages. Multiple dispensers and articulating members can be provided such that a user will naturally select the member that is posed or articulated in a manner that corresponds to their emotional state. Accordingly, a method of using the product can include reaction testing of the nature described above which includes offering a set of different dispenser and articulating members (e.g., a container with an attached articulating sad, happy, reflectively posed human shaped figure) to a user, having the user select a dispenser and articulating member corresponding to their emotional state, then the user will avail themselves of a dispensed product corresponding to a need that is likely to be felt due to their emotional state.

A user will also manipulate the articulating member in such a way that the manipulation will likely serve as an emotional outlet for their feelings while being in proximity to at least one dispensed product they will either need, e.g., tissues, or benefit from, e.g., inspirational messages on a tissue. Also, the type of articulating member will be selected and its articulation capabilities be designed based on criteria including age of user, lifestyle, special events, personal milestone events (promotion, $50^{th}$ birthday, etc.), type of personality a user may be expected to have, an expected emotional state or other factors that can be determined in advance such as love, grieving, excited, somber, moody and the like. Messages that may be used can also be selected or designed using the same criteria used for selecting the articulating member selection. For example, a grieving person may select a figure attached to a dispensing container that is expressing grief, such as in FIG. 1A where the figure can be articulated to express a reflective state of staring into the container. Messages may be incorporated into a product, such as a tissue, which provide an inspirational message for the user who needs comfort as well as a needed product associated with the user's emotional state.

It should be further noted that while the invention has been described with respect to an exemplary tissue dispenser, it should be understood that other objects can also be dispensed, e.g., trash bags, paper towels, facial wipes or other items which are amenable to a container. For example, long strings of separable tissues which also serve as party favors or streamers with bright colors can be dispensed from a container in accordance with an exemplary embodiment of the invention. Alternatively, tissues in the shape and design of clothing that can be pulled from the dispenser and put onto the articulating members e.g., attached figures. A user can then manipulate the figures with the clothing, and then use the dispensed figure clothing as a tissue, party favor, etc. Another embodiment can include dispensing fancy tissues corresponding to a user lifestyle or activity such as, for example, a patterned tissue which can be worn with an outfit or corresponds to an emotional state as described, for example, by the type of figure which is attached to the container. Also, more than one type of object can be dispensed from a container. Also, multiple containers can be used with the invention as well.

As mentioned earlier, various mechanisms can be used to articulate or partially articulate an attachment to suit a user. Rods, strings, motors or other devices can be incorporated into the container and attachment combination in order to facilitate articulation of an attachment.

Mechanical sensors or components can be incorporated into a container which interact with dispensed objects and/or the articulating members attached to the container. For example, when a product is low, the articulating figure can be used to indicate a lower level of dispensed product. For example, a light can be activated (or strobed) which is attached to the figure or container. Such sensors or components are well known in the art and can be of a variety of designs, materials or power sources. It is possible such a container may even be incorporated into a home automation system that monitors an object dispenser.

Figure 12:
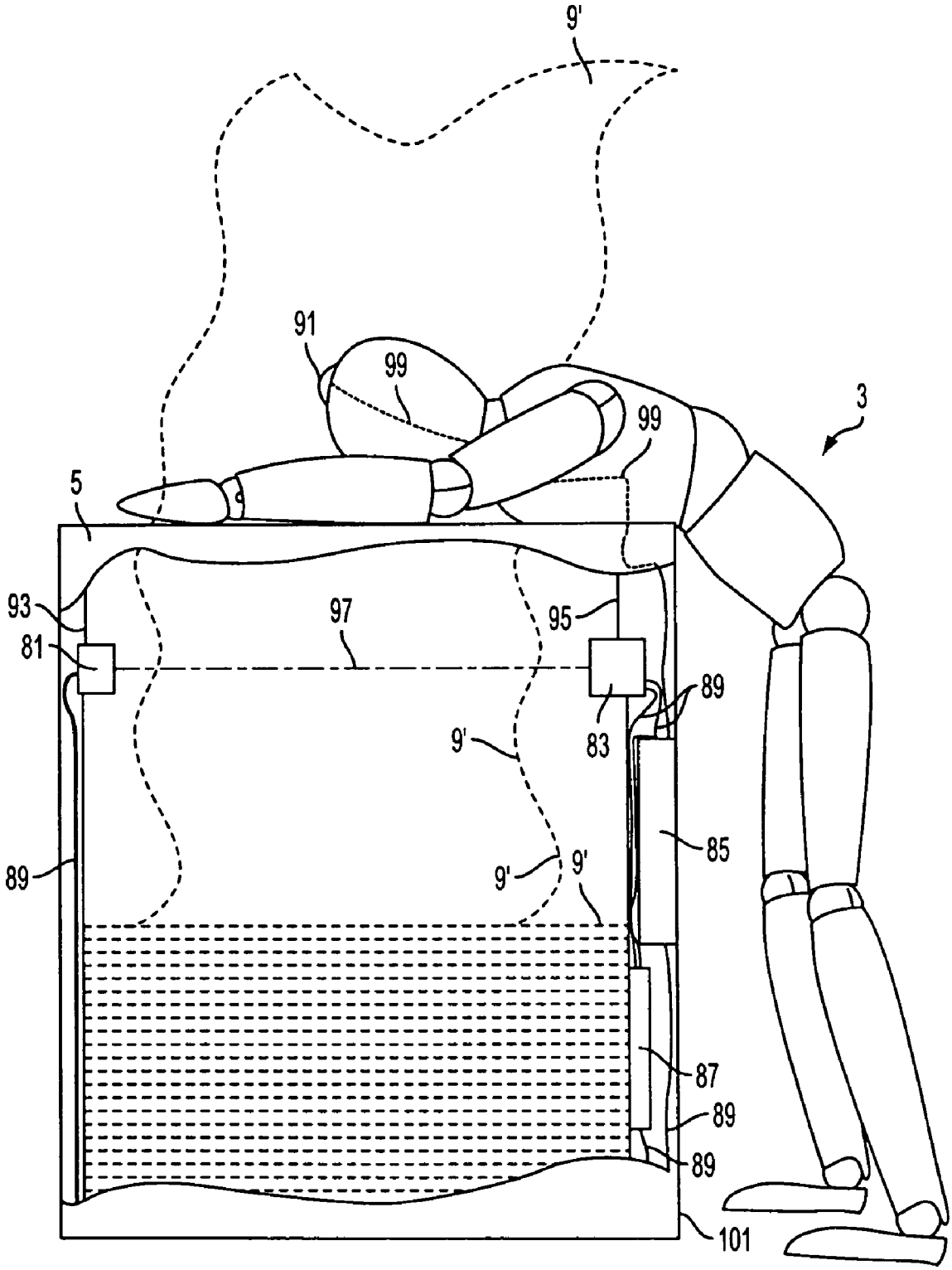
FIG. 12 shows an exemplary embodiment of the invention with an exemplary sensor mechanism.

Referring to FIG. 12, an exemplary embodiment of the invention with one of many possible sensor units is shown. One example of an embodiment of the invention with a sensor system includes light beam sensor components that include a light beam emitter 81 with a focusing apparatus placed into an inner wall panel 93 with a light beam detector 83 positioned on an opposite wall panel 95 of a compartment within container 5 to receive the emitted light beam 97. The light beam emitter 81 can be any light source including, but not limited to, an LED or other light emission device. The detector 83 can, for example, consist of a cadmium sulfide (CdS) cell, a detector lens assembly and a detector assembly-housing unit. The emitted beam 97 is aligned towards the opposing vertical wall 95 within container 5 to ensure the emitted light beam is focused on the detector lens assembly 83. The detector lens assembly within the beam emitter 81 focuses the light beam into a bright spot on the surface of the CdS cell within detector 83. If a colored LED is used in the transmitter, a piece of glass or transparent plastic of the same color can be placed on the CdS cell or other detection mechanism to filter out undesirable light which interferes with the detector's function. A controller 87 is included in the container 5 to operate a signal device, in this case a light 91 on top of member 3. The light 91 is connected to controller 87 through wiring 99 and a portion of wiring 89. A power source 85 is attached to the outer wall 101 or container 5 and is connected to controller 87, detector 83 and emitter 81. Controller 87 controls power distribution to light 91. Additional wiring 89 is distributed throughout the container 5 to connect emitter 81, controller 87 and detector 83. Controller 87 can be programmed to activate light 91 when tissues 9' are emptied from container 5 such that light beam 97 is no longer blocked by tissues 9'. Additional sensor arrangements are possible as well as different signaling devices such as an audible tone or musical sound from an audio source may be incorporated into container 5.

It should be further noted that all embodiments that use container 5 can house an object dispenser or alternatively, container 5 can serve as an object dispenser itself. For example, container 5 can be an actual tissue dispenser as well as configured as a cover for a pre-boxed issue dispenser.

Another aspect of the invention can incorporate a mobile or portable container that dispenses a theme product such as a thematic inspirational message including the message examples discussed above. One exemplary embodiment may have another feature with or without the articulating member described above. For example, a portable message dispenser can have a dimension, which can be attached or placed into clothing, such as in a pocket, or carried in a purse, backpack or personal container. The message dispenser can have a shape or surface attribute, which is readily identifiable with a message theme, including raised lettering associated with a theme for the dispenser or letters embossed on the container spelling a theme for the dispenser. The message dispenser can also have bumps or other protrusions that a person can sense through feel or touch and which are associated with a message theme. A shape or surface identification feature can be selected or designed in a similar manner as the articulating member above. An example of thematic surface features of the message dispenser includes a message dispenser formed in the shape of a coin for an Alcoholics Anonymous sobriety token. The surface of the dispenser may have the logo, graphic, or theme or statements of Alcoholics Anonymous, such as one of the twelve step programs or a triangle with a circle in it. A user can feel the Alcoholics Anonymous symbol as they carry the dispenser in their pocket, and thereby remind themselves without a visual indication, that they must adhere to a certain message or theme. In addition, the user can then, prompted by the feel of the dispenser, pull out the dispenser and pull an inspirational or thematic message that provides an uplifting or strengthening message that is in accordance with the Alcoholics Anonymous program. In such a way, the tactile feel of the written theme and the shape of the dispenser prompt a user to pull out a product from the dispenser, in this case an inspirational message which is consistent with the theme of the product dispenser. In such a way, a theme which is incorporated onto the surface of the dispenser is combined with a shape of a dispenser as well as a message that can be obtained from the message dispenser to achieve a strong effect or reaction in a user.

Another example can be found in making the dispenser in the shape of each letter in the alphabet. The letter "A" can have a selection of words in it that are spelled with the letter "A" and also have phonetic spelling. A child or a person who is learning the English language can carry these message dispensers around with them in order to practice their language skills with respect to a particular letter. Another embodiment can be zoo animals. For example, a dispenser can be shaped in the form of a zoo animal with a texture that matches the animal's skin texture. One embodiment can include a Rhino shaped dispenser that has a rough and bumpy surface or a Zebra formed with a bristly surface. A particular animal shaped dispenser can contain facts about the animal in question. Pictures and other informative information can also be dispensed along with a thematic message such as environmental awareness or saving a species from extinction. The invention can also be shaped into inanimate objects such as a rainforest tree or a well known storybook character.

Figure 13A:
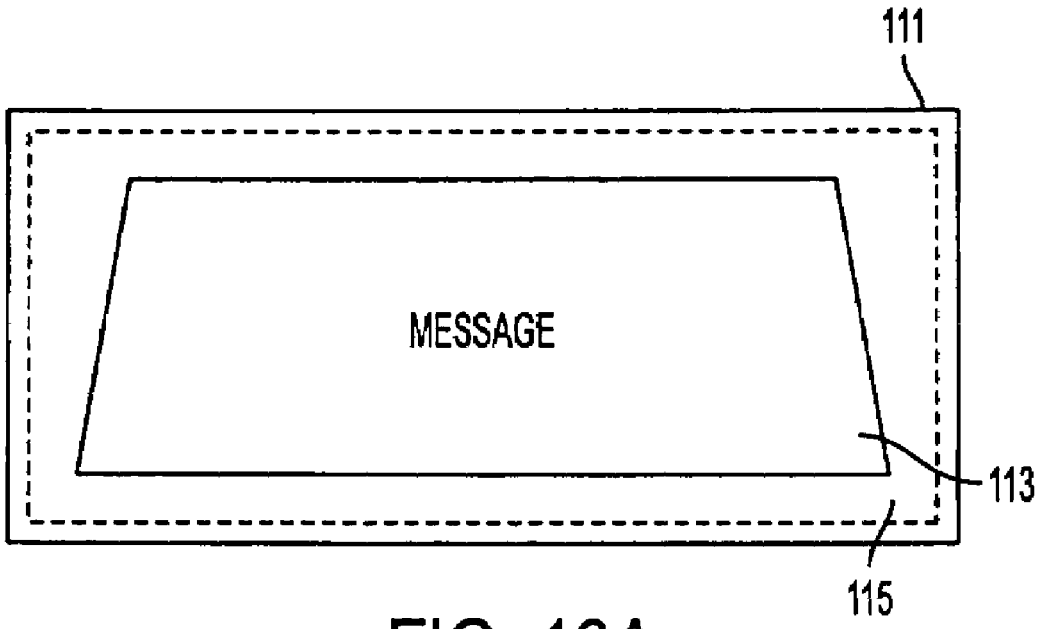
FIG. 13A shows a top view of an exemplary embodiment of the invention with a transparent viewing window.
Figure 13B:
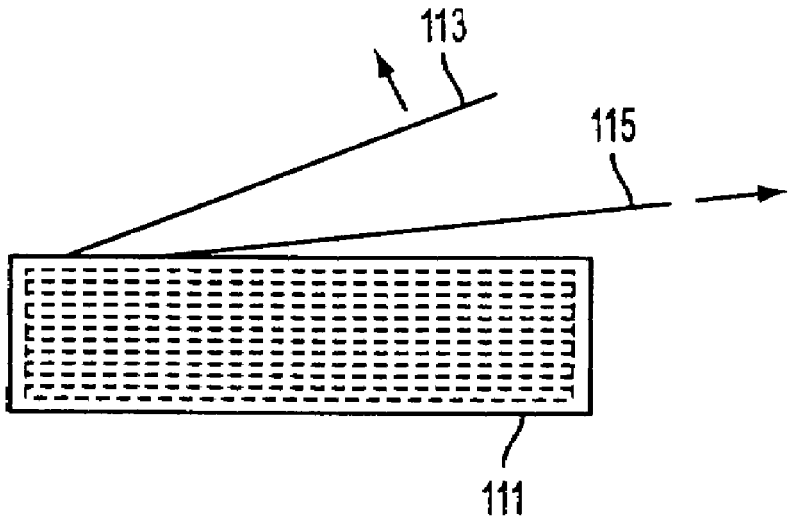
FIG. 13B shows a side view of the FIG. 13A exemplary embodiment.

Another exemplary embodiment can include a container which has a transparent or substantially transparent surface or flap which covers either all or a portion of a contained product with printed messages. Referring to FIG. 13A, the product 115 with the messages are loaded into the container 111 such that the printed messages are viewable through the substantially transparent or transparent surface or flap 113 before one or more of the products are dispensed. A user can remove a product 115 with a printed message from the container 111 and then one or more other messages are visible through the transparent surface or flap 113. Referring to FIG. 13B, the product 115 with a message can be removed by, for example, pulling the transparent surface or flap 113 up, then withdrawing the product 115 with a message from the container 111.

Figure 14A:
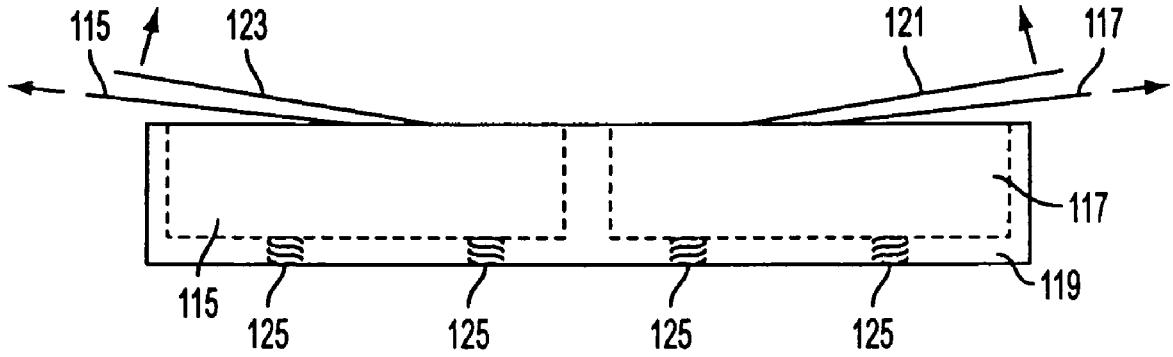
FIG. 14A shows a side view of an exemplary embodiment of the invention with transparent viewing windows.
Figure 14B:
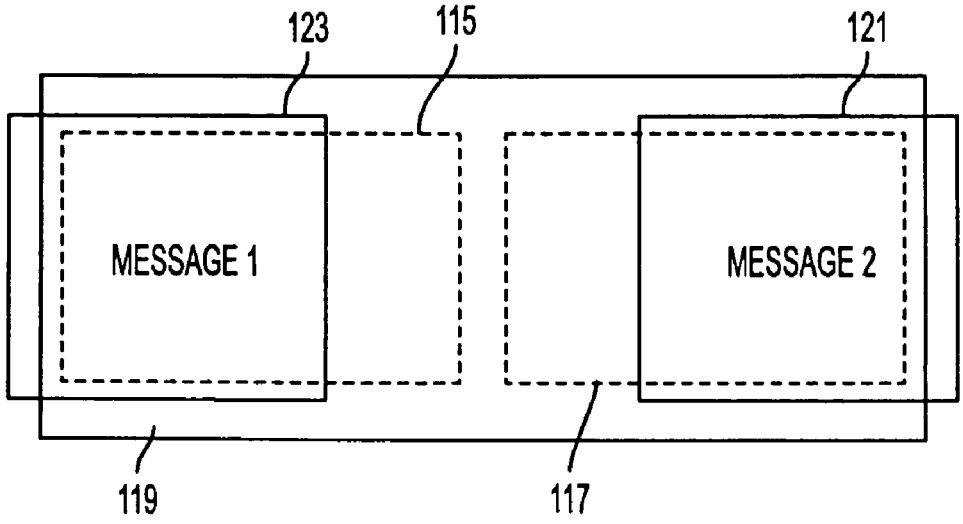
FIG. 14B shows a top view of the FIG. 14A exemplary embodiment.

More than one product can be loaded into a container. Referring to FIG. 14A, container 119 can have two products with messages 115, 117. The products 115, 117 can have the same thematic messages or two different sets of thematic messages printed on the top surface of the product (i.e., 115, 117). A mechanism, such as a spring 125, positions the messages 115, 117 so that they are accessible and ready for dispensing from container 119. Transparent surfaces or flaps 123, 121 cover each set of products with messages 115, 117 within container 119 respectively such that a product 115, 117 can be dispensed from container 119 through an opening that surfaces or flaps 123, 121 can cover. Referring to FIG. 14B, messages printed on products 115, 121 are respectively viewable through the transparent surfaces or flaps 123, 121 which may be lifted to dispense products 115, 117 within container 119.

Figure 15A:
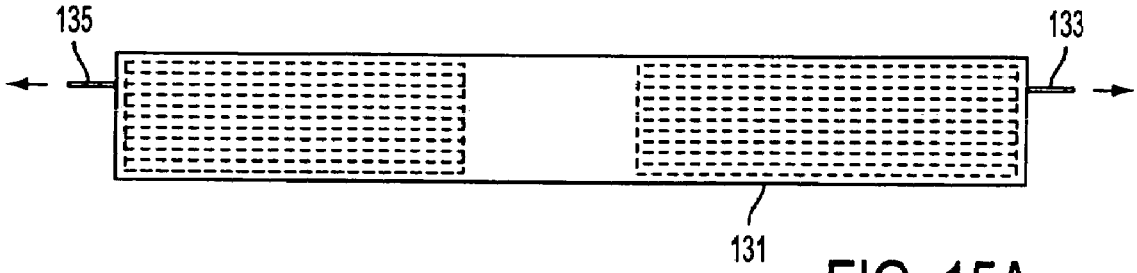
FIG. 15A shows a side view of an exemplary embodiment of the invention with a multiple message dispenser and a transparent viewing window.
Figure 15B:
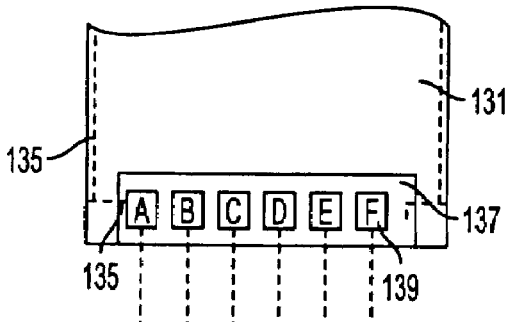
FIG. 15B shows a top view of the FIG. 15A exemplary embodiment.

Another exemplary embodiment can include a container which provides a view of a portion of all of the products contained within the dispenser through an opening or substantially transparent surface of the container. FIG. 15A shows a side view of a product dispenser with two sets of products 133, 135 contained within the dispenser 131. Referring to FIG. 15A, each product (e.g., 135) is marked in such a way that it is possible for a user to determine at least a portion of what is printed on either all or some of the products contained within the container 131. Referring to FIG. 15B, for example, each product 135 may be color coded (e.g., red, blue, yellow, etc.) or marked with a symbol 139 (e.g., A, B, C, D, or a heart, smiley face, etc) that correspond to a message type or theme on a viewable portion of all loaded products (e.g., 135). The product 135 markings (e.g., 139) may be viewed through the container 131 in a variety of ways including a top view seen through a window or transparent surface 137 that permits a view of a portion of each product in the dispenser. The container is formed such that a user can remove one or more products from the dispenser without regard for the order that the products are in within the dispenser. For example, tabs 139, are formed on each product in the container 131 and are viewable through a transparent surface 137 in the top of container 131. The products (e.g., 133, 135) do not need to be serially dispensed.

Figure 15C:
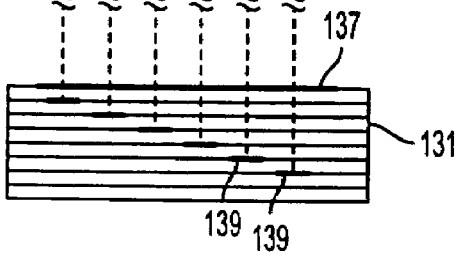
FIG. 15C shows an end view of the FIG. 15A exemplary embodiment of the invention.

Referring to FIG. 15C, an end view of the FIGS. 15A and 15B container 131 is shown. Products (e.g., 133, 135) may be dispensed from the ends of container 131 and identified by tabs 139.

Figure 15D:
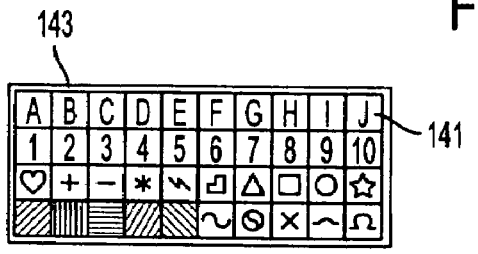
FIG. 15D shows an end view of an exemplary embodiment partially based on the FIG. 15A exemplary embodiment.
Figure 15E:
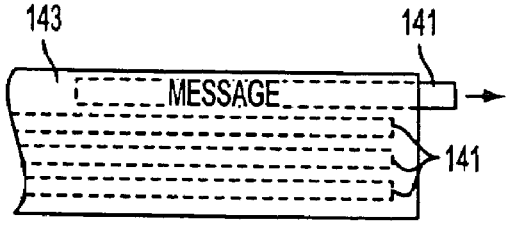
FIG. 15E shows a side view of the FIG. 15D exemplary embodiment.
Figure 15F:
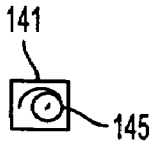
FIG. 15F shows an exemplary embodiment of an object that can be contained in the FIG. 15D exemplary embodiment of the invention.

Other types of designs which permit random dispensation and identification of products contained within the container are possible as well. Referring to FIG. 15D, an end view of a container 143 is shown which contains a collection of substantially rectangular objects 141 which are marked with a unique or thematic message specific symbol or marking. For example, a rectangular object 141 may be marked with letters, numbers, symbols (e.g., heart, lighting bolt, triangle, etc) as well as art designs such as a series of diagonal lines. Container 143 is designed with friction or retaining elements that allow removal of rectangular objects 141 from container 143 such that the remainder of other rectangular objects 141 remain in the container. Friction or retaining elements are well known in the art for retaining a message-bearing object within container 143. A variety of removal mechanisms can be employed including pushing on the rectangular objects 141 from an opposite side or a spring loading extraction mechanism can be used which, when an object 141 is pushed in from the perspective of a user viewing the end of a product, a spring unlatches and pushes the object 141 out of container 143. Referring to FIG. 15E, a side view of container 143 is shown which shows an object 141 being removed from container 143. In this embodiment, object 141 has a message on the outer surface of the object 141 that is being removed. However, the invention is not limited to a particular shape of message bearing product, e.g., 141. For example, round objects, triangular objects or star shaped objects may be used within container 143. Referring to FIG. 15F, an exemplary embodiment of object 141 which may be dispensed from container 143 is shown. In this embodiment, a rolled message 145 is contained within rectangular object 145.

The container may be a rigid container or formed using a flexible material such as thin walled plastic sheeting. Also, a portion of the container may be rigid and another portion, such as a transparent viewing flap or surface, may be made of flexible material.

A wide variety of applications and embodiments for a message dispenser unit with a thematic message combined with one or more features including a related surface feature, dispenser shape or tactile feature as well. Messages can be dispensed using a pull feature or tab on each message. The messages are loaded into the dispenser in a variety of ways including from a cartridge or other means that offers the capability to easily load a message pack and then begin dispensing the messages through an opening in the side or top of the dispenser. Visual effects can also be incorporated into the dispenser including lighting effects such as back lighting the tactile or surface features or providing a reading light for a message. Messages can incorporate a capability for a protruding portion of a message to adhere to the side or top of the dispenser in order to secure the message until dispensing is desired by a user. Dispensed products, such as a message, can also have a weak adhesive which permits a user to adhere a dispensed message in a user selected location for further display or contemplation.

While exemplary embodiments of the invention have been described and illustrated, it should be apparent that many changes and modifications can be made without departing from the spirit or scope of the invention.

What is claimed as new and desired to be protected by Letters Patent of the United States is:

1. A product dispenser comprising:

an enclosure adapted to receive and dispense a product; and a first member attached to said enclosure, said first member comprising a plurality of articulating elements, said plurality of articulating elements being movable to a plurality of positions, said first member being attached to said enclosure such that it does not interfere with dispensing of said product, wherein said enclosure is adapted as a base for said first member and said enclosure, said enclosure formed such that positioning of said first member does not result in an imbalance of said first member and said enclosure when said enclosure is placed on a planar surface, wherein said first member is formed to resemble a plurality of human anatomical elements, and wherein said plurality of anatomical elements comprise an articulating head attached to a torso, a set of articulating arms attached to the torso, a hand representation attached to each arm, jointed legs attached to the torso and a foot representation attached to each leg.

2. The product dispenser of claim 1, further comprising:

a second member attached to said enclosure, said second member comprising a plurality of articulating elements, said plurality of elements being movable to multiple positions.

3. The product dispenser of claim 1, wherein said product dispenser is a paper tissue dispenser.

4. The product dispenser of claim 3, wherein said paper tissue dispenser is inserted into an opening in the bottom of said container.

5. The product dispenser of claim 3, wherein said container is constructed to permit the dispensing of paper tissue from said paper tissue dispenser through an opening in the top portion of said container.

6. The product dispenser of claim 1, further comprising a plurality of covering items, said covering items comprising one of clothing and human apparel.

7. The product dispenser of claim 1, wherein:

said first member is attached to said enclosure with a fastener adapted to attach, detach and reattach said enclosure with said first member, and said fastener is Velcro.

8. The product dispenser of claim 1, wherein said enclosure is formed with a reflective top and sides.

9. The product dispenser of claim 1, wherein said enclosure is formed with a plurality of sides, said sides are formed with transparent or semi-transparent material and said first member is attached within said enclosure between one of said sides and said product dispenser within said enclosure.

10. The product dispenser of claim 9, wherein said enclosure further comprises a wall portion within said enclosure positioned between said product dispenser and one of said plurality of sides of said enclosure, said first member is positioned between said one of said plurality of sides of said enclosure and said wall portion within said enclosure.

11. The product dispenser of claim 10, wherein said wall portion within said enclosure comprises a metal and said first member has one or more magnetic portions which magnetically adhere to said wall portion within said enclosure.

12. The product dispenser of claim 10, wherein said first member is formed from a material which is affected by magnetic fields, said product dispenser further comprising a magnetic member which moves said first member when said magnetic member is moved.

13. The product dispenser of claim 12, wherein said magnetic member is externally movable with respect to said first member.

14. The product dispenser of claim 10, further comprising an illuminating portion interposed between said product dispenser and said first member such that said first member is backlit from an external perspective to said first member.

15. The product dispenser of claim 14, wherein said illuminating portion comprises a lighting fixture which emits a light towards said first member.

16. The product dispenser of claim 14, wherein said illuminating portion comprises a plurality of light emitting diodes which are positioned to focus light towards said first member and said side of said enclosure that is in closest proximity to said first member.

17. The product dispenser of claim 10, further comprising a means for manipulating said first member externally of said enclosure.

18. The product dispenser of claim 17, wherein said means for manipulating said first member comprise strings or rods attached to one or more portions of said first member, said strings or rods extending to an external portion of said enclosure.

19. The product dispenser of claim 10, further comprising one or more adhesive portions coupled to said first member, said adhesive portions are coupled to one of said sidewall.

20. The product dispenser of claim 19, wherein said adhesive portions comprise a suction cup.

21. The product dispenser of claim 19, wherein said adhesive portions comprise a semi adhesive substance comprising a tacky substance.

22. The product dispenser of claim 1, wherein at least one exterior portion of said product dispenser is formed with one of a white and reflective surface positioned behind said first member.

23. The product dispenser of claim 1, wherein a first member comprises a plurality of articulating members forming a representation of an articulating robot.

24. The product dispenser of claim 1, wherein said first member comprises bendable wire coupling said articulating elements.

25. The product dispenser of claim 1, wherein said enclosure further comprises at least another product that is different than said product in said enclosure.

26. The product dispenser of claim 1, further comprising a sensor attached within said enclosure that detects a predetermined condition with respect to said product within said enclosure.

27. The product dispenser of claim 26, further comprising a controller and a signaling device activated by said controller when said sensor detects said predetermined condition.

28. The product dispenser of claim 26, wherein said signaling device is a light or a audible signaling device that activates when said predetermined condition is detected by said sensor.

29. The product dispenser of claim 26, wherein said sensor comprises a light beam source and a light sensor for detecting said light beam source, said product is positioned between said light and light sensor, said predetermined condition occurs when said product is dispensed to the point where said product no longer blocks said light beam and said light sensor detects said light beam.

30. The product dispenser of claim 1, wherein said product is a substantially planar product with raised portions on said product.

31. The product dispenser of claim 1, wherein said enclosure has portions with a plurality of shapes formed into said an external portion of said enclosure, each shape indicating a type of product which is dispensed from a particular location within said enclosure.

32. The product dispenser of claim 1, wherein said enclosure further comprises a transparent flexible portion which covers one or more said products and permits said products to be viewed before being dispensed, said transparent flexible portion can be lifted to permit a product to be dispensed from said enclosure.

33. The product dispenser of claim 1, wherein a plurality of said products are provided within said enclosure, each of said products is a different product and has a different raised portion forming a shape.

34. The product dispenser of claim 33, wherein said products are retained within said enclosure with retaining elements adapted to allow removal of said products and retain said products within said enclosure until said products are removed.

35. The product dispenser of claim 1, wherein said first member comprises a transparent flexible flap portion that can be positioned to uncover a printed portion on a product contained within said enclosure.

36. A product dispenser comprising:

an enclosure adapted to receive and dispense a product; and a first member attached to said enclosure, said first member comprising a plurality of articulating elements, said plurality of articulating elements being movable to a plurality of positions, said first member being attached to said enclosure such that it does not interfere with dispensing of said product, wherein said enclosure is adapted as a base for said first member and said enclosure, said enclosure formed such that positioning of said first member does not result in an imbalance of said first member and said enclosure when said enclosure is placed on a planar surface, wherein said first member comprises a plurality of elements collectively shaped as one of a mammal, marine, reptile and bird forms, and wherein said mammal form comprises an articulating body portion, an articulating head portion coupled to said body portion and a set of articulating leg portions coupled to said body portion.

37. The product dispenser of claim 36, wherein said mammal form further comprises an articulating tail portion coupled to said body portion.

38. A product dispenser comprising:

an enclosure containing a product dispenser containing one or more products; and an articulating member coupled to said enclosure, said articulating member being adapted to be moved to one of a plurality of positions, wherein said product dispenser contains at least one product, said products comprising one or more printed portions, said printed portions comprising text or graphical portions, and wherein said articulating member is attached to said enclosure with a fastener adapted to attach, detach and reattach said enclosure with said first body member.

39. The product dispenser of claim 38, wherein said articulating member comprises a transparent flexible flap portion that can be positioned to uncover or display said text or graphical portions.

40. The product dispenser of claim 38, wherein said fastener is weak adhesive.

41. The product dispenser of claim 40, wherein said enclosure is formed with exterior ornamentation including a reflective top and sides.

42. The product dispenser of claim 38, wherein said enclosure further comprises a plurality of sides, said sides are formed with transparent or semi-transparent material and said first member is attached within said enclosure between one of said sides and said product dispenser within said enclosure.

43. The product dispenser of claim 42, wherein said enclosure further comprises a wall portion within said enclosure positioned between said product dispenser and one of said plurality of sides of said enclosure, said first member is positioned between said one of said plurality of sides of said enclosure and said wall portion within said enclosure.

44. A method of manufacturing a product dispenser, comprising:

forming an enclosure adapted to receive and dispense a product; coupling a first member to said enclosure, said first member comprising a plurality of articulating elements, said plurality of articulating elements being movable to a plurality of positions, said first member being attached to said enclosure such that it does not interfere with dispensing of said product;

providing said product within said enclosure; and wherein said act of forming an enclosure further comprises forming an enclosure with a plurality of sides, said sides are formed with one of a transparent and semi-transparent material.

45. The method of claim 44, wherein said act of forming an enclosure further comprises forming an opening and retaining mechanism in said enclosure adapted to receive, retain and release a product dispenser, and wherein said product dispenser is a paper tissue dispenser.

46. The method of claim 44, further comprising covering said first member with a plurality of covering items comprising one of clothing and items of apparel.

47. The method of claim 44, further comprising:

forming a fastener on said enclosure coupling said first member to said enclosure, said fastener is adapted to releasably attach at least one portion of said first member to said enclosure, wherein said act of forming a fastener on said enclosure comprises forming a first Velcro portion on said enclosure and a second Velcro portion on said first member.

48. The method of claim 44, further comprising:

forming a fastener on said enclosure coupling said first member to said enclosure, said fastener is adapted to releasably attach at least one portion of said first member to said enclosure, wherein said act of forming a fastener on said enclosure comprises forming a weak adhesive on one of said first member or said enclosure adapted to releasably couple said first member and said enclosure.

49. The method of claim 44, wherein said act of forming an enclosure further comprises forming an enclosure with reflective sides and a top.

50. The method of claim 44, wherein said act of coupling a first member to said enclosure further comprises attaching said first member within said enclosure between one of said sides and said product within said enclosure.

51. The method of claim 44, wherein said act of forming an enclosure further comprises forming a wall portion within said enclosure positioned between said product and one of said plurality of sides of said enclosure, said first member is positioned between said one of said plurality of sides of said enclosure and said wall portion within said enclosure.

52. The method of claim 51, wherein said act of forming an enclosure further comprises forming said wall portion within said enclosure from a metal capable of attracting a magnetic material.

53. The method of claim 52, wherein said first member has one or more magnetic portions which magnetically adhere to said wall portion within said enclosure.

54. The method of claim 51, wherein said act of forming said enclosure further comprises forming an illumination portion interposed between said product dispenser and said one of said plurality of sides closest to said first member such that said first member is backlit from an external perspective to said first member.

55. The method of claim 44, wherein said act of forming said enclosure further comprises forming a sensor portion positioned to detect a predetermined condition with respect to said product within said enclosure, a controller portion and a signaling portion within said enclosure, said sensor and controller portion detects a predetermined condition and activates said signaling device.

56. The method of claim 44, wherein said act of forming said enclosure further comprises forming portions on said enclosure or a dispenser within said enclosure containing said products with a plurality of shapes formed into said an external portion of said enclosure or dispenser, each shape indicating a type of product which is dispensed from a particular location within said enclosure or dispenser.

57. The method of claim 44, further comprising forming said first member as a flexible planar portion which covers one or more said products and permits one or more said products to be viewed before being dispensed when said transparent flexible portion is lifted to permit a product to be viewed and selectively dispensed from said enclosure.

58. The method of claim 44, wherein a plurality of said products are provided within said enclosure, each of said products being a different product and has a different raised portion forming a different shape.

59. A method of dispensing a product from a product dispenser, comprising:

positioning a product dispenser containing a plurality of products in an enclosure adapted to receive and dispense a product from said product dispenser;

manipulating a first member coupled to said enclosure; and retrieving a product from said enclosure, wherein said first member comprises a plurality of articulating elements, said plurality of articulating elements are movable to a plurality of positions, said first member is attached to said enclosure such that it does not interfere with dispensing of said product, wherein said enclosure is adapted as a base for said first member, said enclosure formed such that is stabilizes said enclosure when it is placed on a planar surface, and wherein said act of retrieving a product further comprises moving said first member to reveal an opening in said enclosure wherein said product is exposed and retrieving said product from said opening.

60. The method of claim 59, further comprising arranging one or more items of apparel on said first member.

61. The method of claim 59, wherein said act of retrieving one of said plurality of products from said enclosure comprises retrieving a paper tissue from said enclosure with one or more of a text, graphic or embossed portion representing a symbol, text or graphic portion thereon.

62. The method of claim 59, wherein said act of retrieving a product from said enclosure comprises removing a paper tissue with one or both of a text and graphic portion on said tissue from an opening in a top or side portion of said enclosure.

63. The method of claim 59, further comprising providing a plurality of said enclosures with said product dispensers to a plurality of persons, each of said plurality of product dispensers has a different product than products in other said product dispensers.

64. The method of claim 63, wherein said step of retrieving a product from said enclosure further comprises selectively retrieving one of said plurality of products contained within one of said product dispenser based upon one of a symbol, one or more raised portions on at least one said products or containers for said plurality of products or other mark on each of said plurality of products or said containers for each of said plurality of products contained within said enclosures.

65. The method of claim 64, wherein said plurality of different products comprise products with inspirational, bereavement, birthday, relationship anniversary, work promotion or personal event related text or graphic printed portions on said products.

66. The method of claim 65, further comprising lifting a covering portion over said enclosure uncovering one or more of said products.

67. The method of claim 66 wherein said act of selecting of said plurality of products is further based upon tactile sensing by said person of one of a plurality of raised portions of each of said plurality of products.

68. A method of dispensing a product from a product dispenser, comprising:

positioning a product dispenser containing a plurality of products in an enclosure adapted to receive and dispense a product from said product dispenser;

manipulating a first member coupled to said enclosure; and retrieving a product from said enclosure, wherein said first member comprises a plurality of articulating elements, said plurality of articulating elements are movable to a plurality of positions, said first member is attached to said enclosure such that it does not interfere with dispensing of said product, wherein said enclosure is adapted as a base for said first member, said enclosure formed such that is stabilizes said enclosure when it is placed on a planar surface, and wherein said act of manipulating said first member comprises moving said first member, wherein said first member is positioned between said product within said enclosure and one of a plurality of semitransparent or transparent sides of said enclosure.

69. The method of claim 68, further comprising illuminating said first member from within said enclosure.

* * * * *